US007371184B2

(12) United States Patent
Tao

(10) Patent No.: US 7,371,184 B2
(45) Date of Patent: May 13, 2008

(54) PUTTER HEAD

(76) Inventor: Tadamasa Tao, 13-16, Takasuhigashi 4-chome, Wakamatsu-ku-shi, Kitakyushu-shi (JP)

( * ) Notice: Subject to any disclaimer, the term of this patent is extended or adjusted under 35 U.S.C. 154(b) by 267 days.

(21) Appl. No.: 11/148,445

(22) Filed: Jun. 9, 2005

(65) Prior Publication Data

US 2006/0014590 A1 Jan. 19, 2006

(30) Foreign Application Priority Data

Jun. 10, 2004 (JP) ..... 2004-171984
Mar. 22, 2005 (JP) ..... 2005-080824

(51) Int. Cl.
*A63B 69/36* (2006.01)

(52) U.S. Cl. ..... 473/242; 473/251; 473/249; 473/255

(58) Field of Classification Search ..... 473/219–256, 473/340–341; D21/736–746, 751
See application file for complete search history.

(56) References Cited

U.S. PATENT DOCUMENTS

D58,209 S * 6/1921 Bacheller ..... D21/745
1,485,272 A * 2/1924 Kinsman ..... 473/242
D183,180 S * 7/1958 Phillips ..... D21/745
2,859,972 A * 11/1958 Reach ..... 473/242
2,908,504 A * 10/1959 Pratt ..... 473/237
2,957,696 A * 10/1960 Warpotas ..... 473/251
D205,041 S * 6/1966 Capps ..... D21/759
3,649,028 A * 3/1972 Worrell ..... 473/220
3,884,477 A * 5/1975 Bianco ..... 473/249
D236,736 S * 9/1975 Winter ..... D21/746
D245,437 S * 8/1977 Thiel ..... D21/745
4,174,839 A * 11/1979 Marrs ..... 473/252
4,659,083 A * 4/1987 Szczepanski ..... 473/252
4,762,324 A * 8/1988 Anderson ..... 473/249
4,819,943 A * 4/1989 Szczepanski ..... 473/252
5,203,565 A * 4/1993 Murray et al. ..... 473/242
5,433,446 A * 7/1995 Lindstedt, Jr. ..... 473/242
5,728,007 A * 3/1998 Eakin ..... 473/244
5,839,970 A * 11/1998 Lombardo ..... 473/252
D405,137 S * 2/1999 Nelson ..... D21/738
5,984,800 A * 11/1999 Uebelhor ..... 473/251
6,244,974 B1 * 6/2001 Hanberry, Jr. ..... 473/242

(Continued)

*Primary Examiner*—Sebastiano Passaniti
(74) *Attorney, Agent, or Firm*—Browdy & Neimark

(57) ABSTRACT

The present invention provides a putter head which includes a putter head body which has a portion thereof connected to a distal end of a putter shaft; a laterally extending putter face which is formed on a front portion of the putter head body; a strip-like longitudinal line mark which is capable of being aligned with an imaginary ball hitting line at an address position, the longitudinal line mark being formed on an upper surface of the putter head body and extending rearwardly from a center of the putter face in the direction orthogonal to the putter face; and blurring marks which are formed on the upper surface of the putter head body in a state that the blurring marks sandwich the longitudinal line mark, the blurring marks having profile lines which are arranged substantially symmetrically and non-parallel with respect to the longitudinal line mark, wherein the profile of one blurring mark is arranged approximately parallel to the imaginary ball hitting line at a take-back position and the profile line of another blurring mark is arranged approximately parallel to the imaginary ball hitting line at a follow-through position.

15 Claims, 16 Drawing Sheets

U.S. PATENT DOCUMENTS 6,350,208 B1 * 2/2002 Ford ..... 473/249
6,739,980 B2 * 5/2004 Scott et al. ..... 473/200
6,988,955 B2 * 1/2006 Stoakes ..... 473/242
7,077,757 B1 * 7/2006 Payne et al. ..... 473/238
7,077,758 B2 * 7/2006 Rohrer ..... 473/251
2005/0037854 A1 * 2/2005 Green ..... 473/226
2005/0075185 A1 * 4/2005 Green ..... 473/240
2005/0187028 A1 * 8/2005 Chang et al. ..... 473/231
2005/0192114 A1 * 9/2005 Zider et al. ..... 473/251

* cited by examiner

PUTTER HEAD

CROSS-REFERENCES TO RELATED APPLICATIONS

The disclosure of Japanese Patent Application JP2004-171984 filed on Jun. 10, 2004 and Japanese Patent Application JP2005-080824 filed on Mar. 22, 2005 including the specifications, the drawings and abstracts are incorporated herein by reference in its entirety.

BACKGROUND OF THE INVENTION

1. Field of the Invention

The present invention relates to a putter head which gives a sense of smooth and comfortable stroking to a golfer while allowing the golfer to hit a golf ball so that the golf ball accurately travel on an imaginary ball hitting line direction.

2. Description of the Related Art

FIG. 3 shows one type of conventionally known putter. As shown in FIG. 3, the putter includes a grip portion 99*b* which is adapted to be grasped by a golfer, a shaft 100 extending linearly downward from the grip portion 99*b*, and a putter head 99 which is connected to a distal end of the shaft 100. The putter head 99 has a laterally extending putter face on a front portion of a putter head body and a strip-like longitudinal line mark 102 which is formed on an upper surface of the putter head body and extends rearwardly from a center (so-called "sweet spot") 23 of the putter face 22 in the direction orthogonal to the putter face 22.

Due to such a constitution, the putter allows the golfer to easily align the longitudinal line mark 102 with the imaginary ball hitting line direction 109. Further, when the above-mentioned longitudinal line mark 102 which emphasizes the longitudinal direction becomes long and conspicuous in the imaginary ball hitting line direction 109, the alignment of the longitudinal line mark 102 with the imaginary ball hitting line direction 109 maybe facilitated. However, in an actual putting operation to take back the putter head 99 straightly parallel to the imaginary ball hitting line direction 107 and, thereafter, to swing the putter head 99 forward straightly parallel to the imaginary ball hitting line direction 109, the larger the take-back or the follow-through becomes, the swing stroke is liable to take an arcuate trajectory 110 in a horizontal plane as shown in FIG. 3. In this case, the longer and the more conspicuous the longitudinal line mark 102, the inclination of the longitudinal line mark 102 with respect to the imaginary ball hitting line direction 109 at the take-back position and the follow-through position is increased and hence, the golfer tends to easily recognize the inclination of the longitudinal line mark 102 with his/her naked eyes. Accordingly, the golfer strongly feels the arcuate swinging of the putter head 99 on the horizontal plane due to the inclination and this feeling damages his/her image to perform the stroke parallel to the imaginary ball hitting line direction 109.

FIG. 4 shows another type of conventionally known putter. Here, a putter head 99*a* has a laterally extending putter face on a front portion of a putter head body and two circular marks 105, 105 which have the same diameter and are formed on an upper surface of the putter head body and are arranged rearwardly in a spaced-apart manner from a center (so-called "sweet spot") 23 of the putter face 22 in the direction orthogonal to the putter face 22.

Due to such a constitution, the putter allows the golfer to easily align an imaginary center line of two circular marks 105 with the imaginary ball hitting line direction 109. Further, when the above-mentioned circular marks 105 which emphasizes the longitudinal direction becomes more conspicuous by coloring, the alignment of the circular marks 105 with the imaginary ball hitting line direction 109 may be facilitated. However, as described previously in conjunction with FIG. 3, in the actual putting operation to take back the putter head 99*a* straightly parallel to the imaginary ball hitting line 109 and, thereafter, to stroke the putter head 99*a* forward straightly parallel to the imaginary ball hitting line direction 109, the larger the take-back stroke or the follow-through stroke becomes, the stroke is liable to take an arcuate trajectory 110 on a horizontal plane as shown in FIG. 4. In this case, two profile lines 107 of the putter head body are arranged parallel to the imaginary ball hitting line direction 109 and, at the same time, two tangential lines 108 which connect circumferential portions of two circular marks 105, 105 having the same diameter on both sides of the imaginary center line of two circular marks 105 are arranged parallel to the imaginary ball hitting line direction 109. Accordingly, the inclination of the imaginary center line of the circular marks 105, 105 with respect to the imaginary ball hitting line direction 109 at the take-back position and the follow-through position is increased and hence, the golfer tends to easily recognize the inclination of the imaginary center line of the circular marks 105 with his/her naked eyes. Accordingly, the golfer strongly feels the arcuate swinging of the putter head on the horizontal plane due to the inclination and this feeling damages his/her image to perform the stroke parallel to the imaginary ball hitting line direction 109.

FIG. 5 shows another type of conventionally known putter. As shown in FIG. 5, the putter includes a grip portion (not shown in the drawing) which is adapted to be grasped by a golfer, a shaft 100 extending linearly downward from the grip portion, and a putter head 107 which is connected to a distal end of the shaft 100. The putter head 107 has a laterally extending putter face ona front portion of a putter head body, a pair of triangular marks 103 which are formed on an upper surface of the putter head body and are arranged symmetrically with respect to an imaginary center line which extends rearwardly from a center (so-called "sweet spot") 23 of the putter face 22 in the direction orthogonal to the putter face 22, and a strip-like longitudinal line mark 104 which is formed between the pair of triangular marks 103.

Due to such a constitution, the putter allows the golfer to easily align the longitudinal line mark 104 with the imaginary ball hitting line direction 109. Further, when the above-mentioned longitudinal line mark 104 which emphasizes the longitudinal direction becomes long and conspicuous in the imaginary ball hitting line direction 109, the alignment of the longitudinal line mark 104 with the imaginary ball hitting line direction 109 maybe facilitated. However, in an actual putting operation to take back the putter head 107 straightly parallel to the imaginary ball hitting line 109 and, thereafter, to swing the putter head 107 forward straightly parallel to the imaginary ball hitting line direction 109, the larger the take-back or the follow-through becomes, the swing stroke is liable to take an arcuate trajectory in a horizontal plane in the same manner as the putter head shown in FIG. 3. In this case, the longer and the more conspicuous the longitudinal line mark 104, the inclination of the longitudinal line mark 104 with respect to the imaginary ball hitting line direction 109 at the take-back and the follow-through is increased and hence, the golfer tends to easily recognize the inclination of the longitudinal line mark 104 with his/her naked eyes. Accordingly, the golfer strongly feels the arcuate swinging of the putter head on the horizontal plane due to the inclination and this feeling damages his/her image to perform the stroke parallel to the imaginary ball hitting line direction. Although the putter head includes the pair of triangular marks 103, outer inclined profile lines thereof and corresponding outer profile lines of the putter head body make a large acute angle with respect to the longitudinal line mark 104 and hence, the triangular marks 103 have substantially no effect in blurring the arcuate trajectory of the longitudinal line mark 104 whereby the golfer tends to easily recognize the inclination of the longitudinal line mark 104 with his/her naked eyes.

The present invention has been made to overcome such drawbacks of the related art and it is an object of the present invention to provide a putter head which gives a sense of smooth and comfortable stroking to a golfer while allowing the golfer to hit a golf ball so that the golf ball accurately travel on an imaginary ball hitting line direction.

SUMMARY OF THE INVENTION

To achieve the above-mentioned object, according to a first aspect of the present invention, there is provided a putter head which includes a putter head body which has a portion thereof connected to a distal end of a putter shaft; a laterally extending putter face which is formed on a front portion of the putter head body; a strip-like longitudinal line mark which is capable of being aligned withan imaginary ball hitting line at an address position, the longitudinal line mark being formed on an upper surface of the putter head body and extending rearwardly from a center 23 of the putter face 22 in the direction orthogonal to the putter face; and blurring marks which are formed on the upper surface of the putter head body in a state that the blurring marks sandwich the longitudinal line mark, the blurring marks having profile lines which are arranged substantially symmetrically and non-parallel with respect to the longitudinal line mark, wherein the profile of one blurring mark is arranged approximately parallel to the imaginary ball hitting line at a take-back position and the profile line of another blurring mark is arranged approximately parallel to the imaginary ball hitting line at a follow-through position.

The above-mentioned first aspect of the present invention is also characterized in that the blurring marks are formed in a line shape and have a line width larger than a line width of the strip-like longitudinal line mark.

The above-mentioned first aspect of the present invention is also characterized in that the blurring marks have color different from color of the strip-like longitudinal line mark.

The above-mentioned first aspect of the present invention is also characterized in that the profiles of the blurring marks are formed of longitudinally extending lines and lateral widths of the blurring marks are increased from a front end to a rear end of the putter head body.

The above-mentioned first aspect of the present invention is also characterized in that the profiles of the blurring marks are formed of longitudinally extending lines and lateral widths of the blurring marks are increased from a front end and a rear end of the putter head body to a longitudinally center portion of the putter head body.

The above-mentioned first aspect of the present invention is also characterized in that the profiles of the blurring marks are formed of a ring-like-line shape having a given line width.

The above-mentioned first aspect of the present invention is also characterized in that the ring-like-line shape is a rhombic shape having diagonal lines which cross each other orthogonally and one diagonal line of the rhombic shape is arranged to be overlapped with the longitudinal line mark.

The above-mentioned first aspect of the present invention is also characterized in that the blurring marks are formed by arranging a plurality of marks which have the same shape but differ in size in a spaced-apart manner in the longitudinal direction.

The above-mentioned first aspect of the present invention is also characterized in that the blurring marks are formed by arranging a plurality of circular marks which have the same shape but differ in size in a spaced-apart manner in the longitudinal direction.

The above-mentioned first aspect of the present invention is also characterized in that the blurring marks are formed of a V-shaped mark which has a given line width and is arranged symmetrically with respect to the longitudinal line mark.

The above-mentioned first aspect of the present invention is also characterized in that the blurring marks are formed of a plurality of V-shaped marks which have a given line width and are arranged in a spaced-apart manner in the longitudinal direction and symmetrically with respect to the longitudinal line mark.

The above-mentioned first aspect of the present invention is also characterized in that the blurring marks are formed of a chevron-shaped mark in which the blurring marks have a given line width and are arranged symmetrically with respect to the longitudinal line mark in a state that a width between the blurring marks are gradually increased frontwardly.

The above-mentioned first aspect of the present invention is also characterized in that the blurring marks are formed of a plurality of chevron-shaped marks which have a given line width and are arranged symmetrically with respect to the longitudinal line mark in a state that a width between the blurring marks are gradually increased frontwardly.

The above-mentioned first aspect of the present invention is also characterized in that the putter head further includes a background mark which is mounted on a substantially whole upper surface of the putter head body and the longitudinal line mark and the blurring mark are formed on an upper surface of the background mark.

The above-mentioned first aspect of the present invention is also characterized in that the longitudinal line mark and the blurring mark are colored with color different from color of the putter head body.

The above-mentioned first aspect of the present invention is also characterized in that the longitudinal line mark and the blurring mark are colored with color different from color of the background mark.

The above-mentioned first aspect of the present invention is also characterized in that the blurring mark is replaceably mounted on the upper surface of the putter head body.

The above-mentioned first aspect of the present invention is also characterized in that the blurring mark is mounted on the upper surface of the putter head body by making use of a magnetic attraction.

The above-mentioned first aspect of the present invention is also characterized in that the background mark is replaceably mounted on the upper surface of the putter head body.

The above-mentioned first aspect of the present invention is also characterized in that the background mark is replaceably mounted on the upper surface of the putter head body by making use of a magnetic attraction.

To achieve the above-mentioned object, according to a second aspect of the present invention, there is provided a putter head which includes a putter head body which has a portion thereof connected to a distal end of a putter shaft; a laterally extending putter face which is formed on a front portion of the putter head body; a strip-like longitudinal line mark which is capable of being aligned with an imaginary ball hitting line at an access position, the longitudinal line mark being formed on an upper surface of the putter head body and extending rearwardly from a center 23 of the putter face 22 in the direction orthogonal to the putter face; and blurring marks which are constituted of side profile lines of the putter head body, the blurring marks being arranged substantially symmetrically and non-parallel with respect to the strip-like longitudinal line mark, a width between the blurring marks assuming a narrowest width at a front portion of the putter head body and being gradually increased in the rearward direction symmetrically with respect to the imaginary center line, and the blurring marks being merged at a rear portion of the putter head body to form a dove-tail shape, wherein one blurring mark is arranged approximately parallel to an imaginary ball hitting line at a take-back position and another blurring mark is arranged approximately parallel to the imaginary ball hitting line at a follow-through position.

To achieve the above-mentioned object, according to a second aspect of the present invention, there is provided a putter head which includes a putter head body which has a portion thereof connected to a distal end of a putter shaft; a laterally extending putter face which is formed on a front portion of the putter head body; a strip-like longitudinal line mark which is capable of being aligned with an imaginary ball hitting line at an access position, the longitudinal line mark being formed on an upper surface of the putter head body and extending rearwardly from a center 23 of the putter face 22 in the direction orthogonal to the putter face; and blurring marks which are constituted of side profile lines of the putter head body, the blurring marks being arranged substantially symmetrically and non-parallel with respect to the strip-like longitudinal line mark, a width between the blurring marks being gradually increased toward a center portion of the putter head body from a front portion and a rear portion of the putter head body symmetrically with respect to the strip-like longitudinal line mark thus forming a shape of the putter head body into a rhombic shape having two diagonal lines which cross each other orthogonally, and one diagonal line being aligned with the strip-like longitudinal line mark, wherein one portions of both blurring marks are arranged approximately parallel to an imaginary ball hitting line at a take-back position and another portions of both blurring marks are arranged approximately parallel to the imaginary ball hitting line at a follow-through position.

Due to the above-mentioned constitutions, the present invention can obtain following advantageous effects.

(1) According to the present invention, the blurring marks have profile lines arranged substantially symmetrically and non-parallel with respect to the longitudinal line mark with a lateral gap between the blurring lines and the strip-like longitudinal line mark. Accordingly, although the strip-like longitudinal line mark is necessary to align the putter head with the imaginary ball hitting line at the address position, in the stroking operation of the putter head, due to the provision of the symmetrical and non-parallel blurring marks, the blurring marks attract more attention of a golfer than the strip-like longitudinal line mark during the stroking of the putter head and hence, the longitudinal line mark becomes less conspicuous during the stroking of the putter head. Further, the profile of one blurring mark is arranged approximately parallel to the imaginary ball hitting line at a take-back position and the profile line of another blurring mark is arranged approximately parallel to the imaginary ball hitting line at a follow-through position. Accordingly, a golfer hardly feels the change of the inclination of the longitudinal line mark whereby the putter head can give a sense of smooth and comfortable stroking to the golfer.

(2) With the provision of the background mark, without being influenced by the color of the putter head body, due to the combination of two colors applied to the background mark and the longitudinal line mark and the blurring marks, it is possible to make both of the longitudinal line mark and the blurring marks conspicuous and hence, it is possible to prevent the golfer from having the feeling that the background mark is arcuately swinging during the putting operation.

(3) Further, by making the blurring marks conspicuous, the golfer can easily feel a position of a sweet spot during the putting operation. Particularly, in the constitution in which the width between the blurring marks is gradually narrowed toward the sweet spot from the rear portion of the putter head body where the width between the blurring marks is wide, the golfer's eyes are focused on the sweet spot and hence, it is possible to allow the golfer to concentrate on putting.

(4) Further, by allowing the blurring marks to have a chevron shape in which the width between the blurring marks is gradually increased from a rear end to a front end of the putter head body, the blurring marks wrap the ball in the vicinity of the sweet spot and hence, the golfer can gently and reliably perform the putting.

DETAILED DESCRIPTION OF THE INVENTION

The preferred embodiments of the present invention are explained in detail in conjunction with attached drawings.

Figure 1:
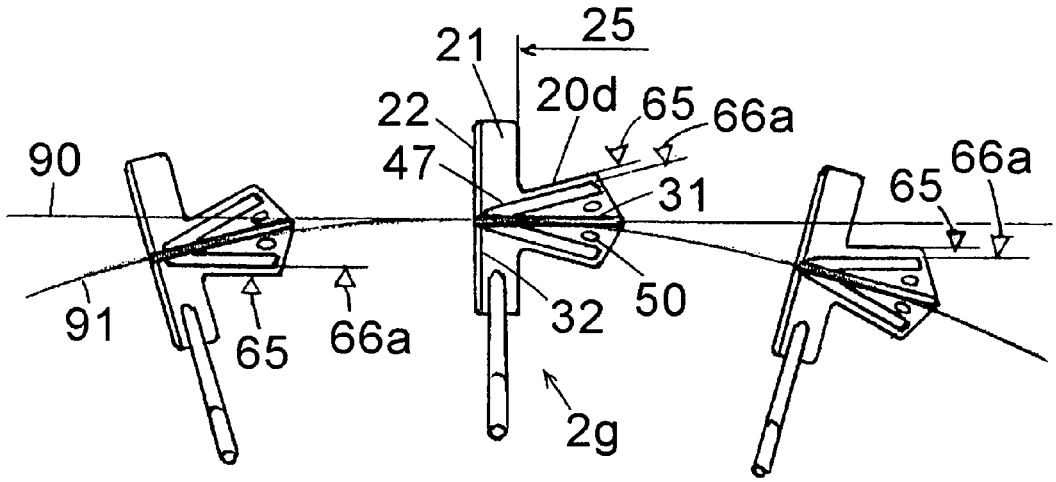
FIG. 1 is an explanatory view of a first embodiment showing a trajectory of stroking of a putter head shown in FIG. 22.
Figure 2:
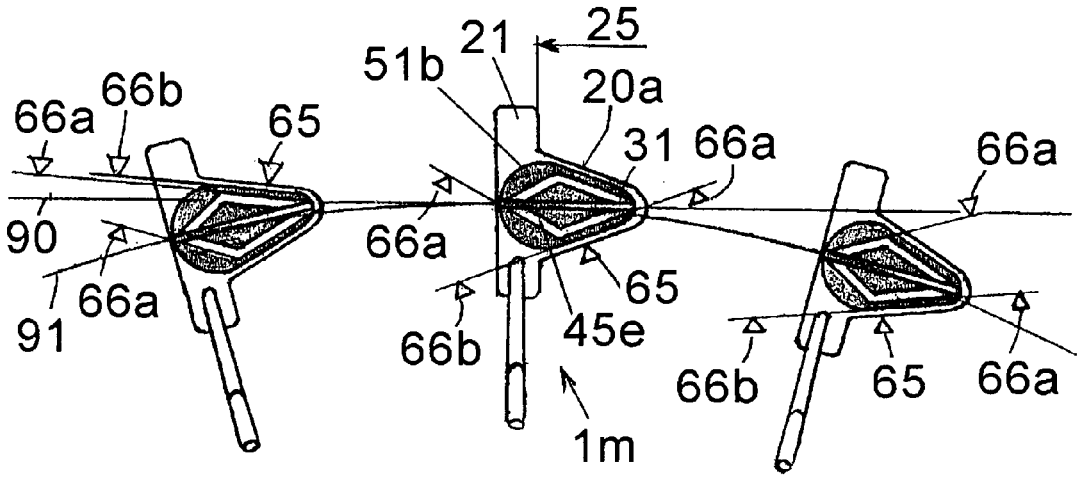
FIG. 2 is an explanatory view of a second embodiment showing a trajectory of stroking of a putter head shown in FIG. 33.
Figure 3:
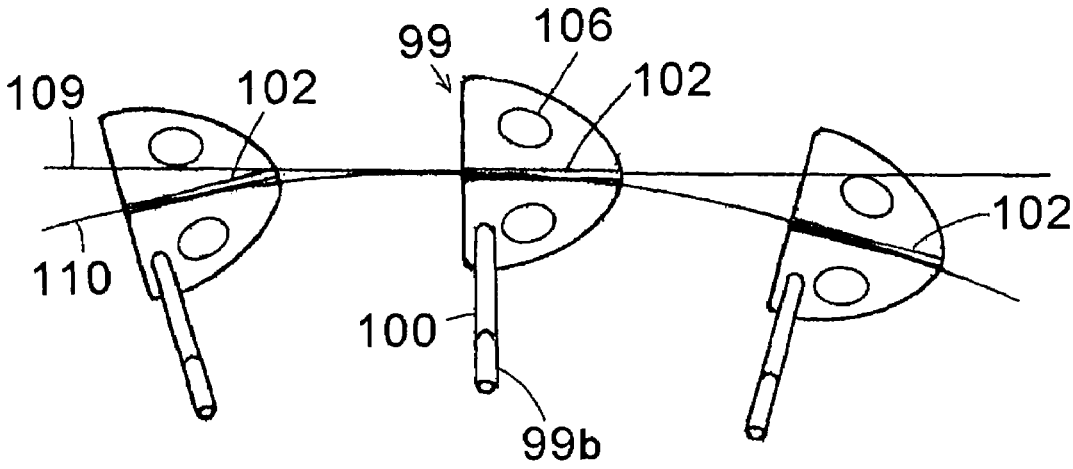
FIG. 3 is an explanatory view showing a trajectory of stroking of a conventional putter head.
Figure 4:
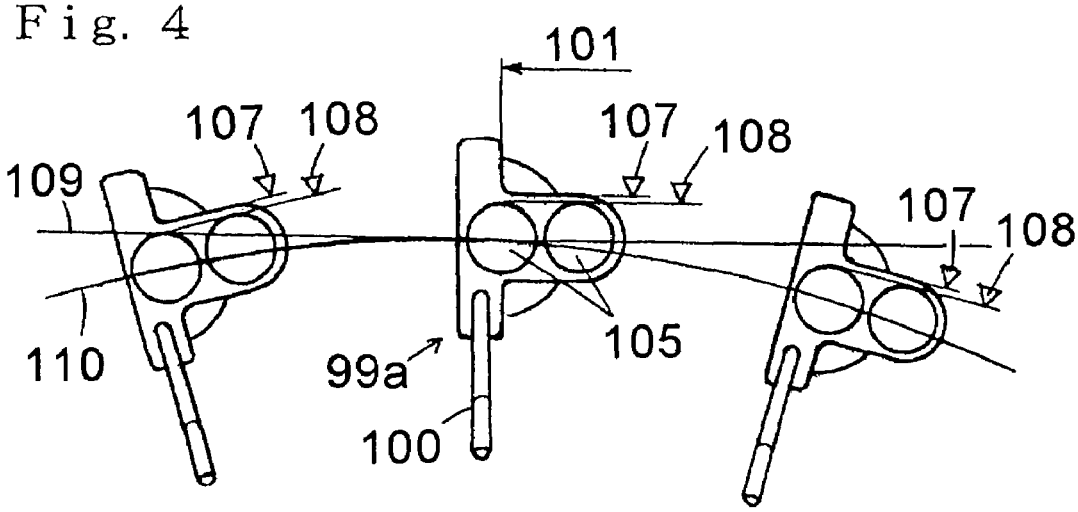
FIG. 4 is an explanatory view showing a trajectory of stroking of a conventional putter head.
Figure 5:
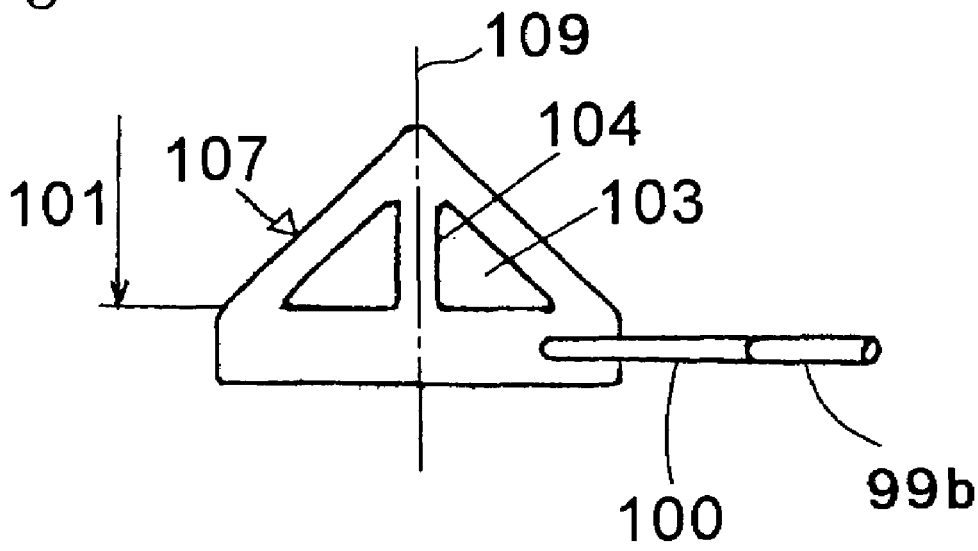
FIG. 5 is a plan view of a conventional putter head.
Figure 21:
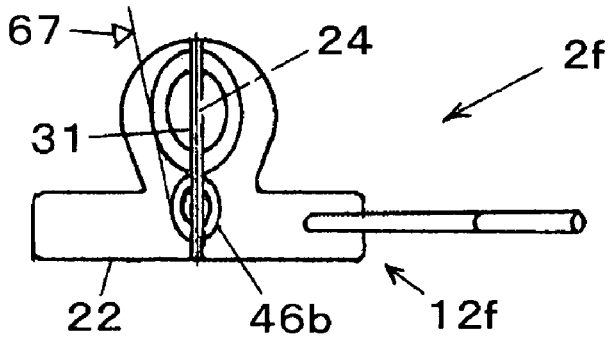
FIG. 21 is a plan view of a putter head of an eighteenth embodiment.
Figure 22:
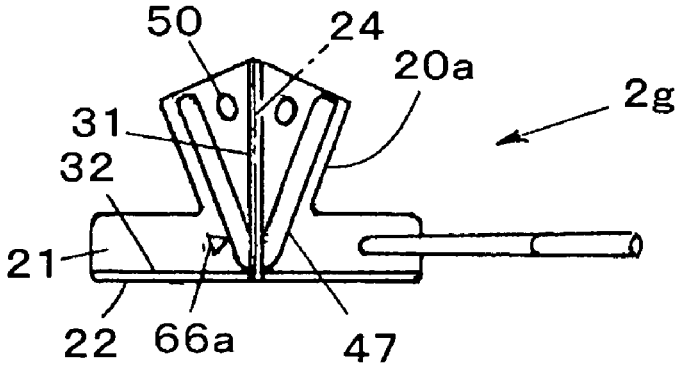
FIG. 22 is a plan view of a putter head of a nineteenth embodiment.
Figure 32:
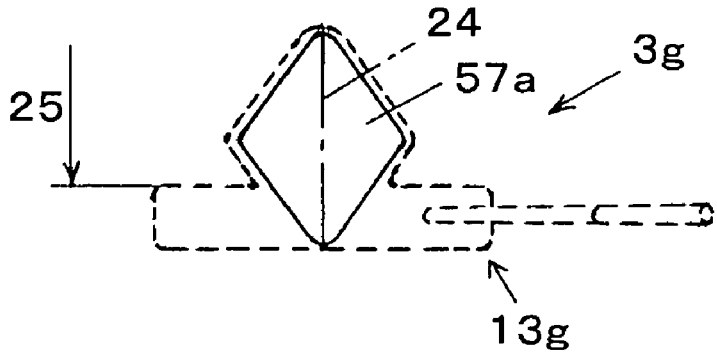
FIG. 32 is a plan view of a putter head of a twenty-ninth embodiment.
Figure 33:
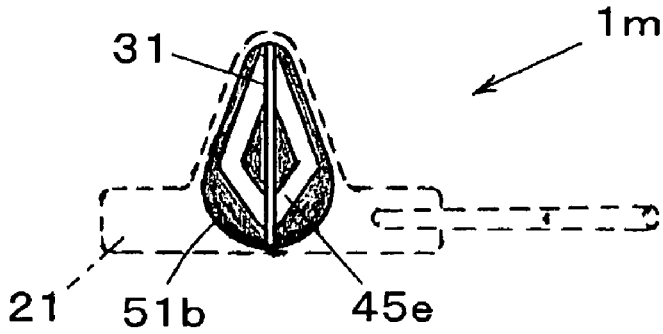
FIG. 33 is a plan view of a putter head of a thirtieth embodiment.

In this specification, first of all, the principle of the present invention is explained in conjunction with FIG. 1 and FIG. 2 which show trajectories of stroking of putter heads shown in FIG. 22 and FIG. 33. Thereafter, the various types of the putter heads to which the present invention is applied are explained in conjunction with FIG. 6 to FIG. 41.

First Embodiment

FIG. 1 is an explanatory view of a first embodiment showing a trajectory of stroking of a putter head 2*g* shown in FIG. 22.

Although the constitution of the putter head 2*g* is explained in detail in conjunction with FIG. 22, in this embodiment, the respective directions of profile lines 65 of a fan-shaped projecting portion 20*a* on a back-surface side of a putter head body and profile lines 66*a* of V-shaped blurring marks 47 formed on an upper surface of the putter head body are arranged to take an oblique posture with respect to an imaginary ball hitting line direction 90 or a strip-like longitudinal line mark 31 which is overlapped to the imaginary ball hitting line direction 90 at an address position. On the other hand, in a take-back position and a follow-through position, as shown in FIG. 1, the profile line 66*a* of one V-shaped blurring mark 47 is arranged approximately parallel to the imaginary ball hitting line direction 90 at a take-back position and the profile line 66*a* of another V-shaped blurring mark 47 is arranged approximately parallel to the imaginary ball hitting line direction 90 at a follow-through position. Further, in this embodiment as well as in succeeding embodiments, the V-shaped blurring marks 47 are made conspicuous by increasing a line width of the blurring marks 47 compared to a line width of the longitudinal line mark 31 as shown in FIG. 1 and FIG. 22. It is also possible to make the V-shaped blurring marks V conspicuous by making color of the V-shaped blurring marks V different from color of the strip-like longitudinal line mark 31.

Accordingly, in the stroking operation of the putter head 2*g*, due to the provision of the blurring marks 47, the longitudinal line mark 31 becomes less conspicuous compared to blurring mark 47. Further, the profile line 66*a* of one blurring mark 47 is arranged approximately parallel to the imaginary ball hitting line direction 90 at the take-back position and the profile line 66*a* of another blurring mark 47 is arranged approximately parallel to the imaginary ball hitting line direction 90 at the follow-through position and hence, the golfer's attention is directed to the blurring mark 47. Accordingly, a golfer hardly feels the change of the inclination of the longitudinal line mark 31 whereby the putter head can give a sense of smooth and comfortable stroking to the golfer.

Further, by making the V-shaped blurring mark 47 more conspicuous by increasing the line width of the blurring mark 47 compared to the line width of the longitudinal line mark 31 as shown in FIG. 1 and FIG. 22, it is possible to further enhance the above-mentioned blurring effect attributed to the blurring marks 47. The same goes for all embodiments described hereinafter.

Second Embodiment

FIG. 2 is an explanatory view of a second embodiment showing a trajectory of stroking of a putter head 1*m* shown in FIG. 33.

Although the constitution of the putter head 1*m* is explained in detail in conjunction with FIG. 33, in this embodiment, the respective directions of profile lines 65 of a mountain-shaped projecting portion 20*a* on a back-surface side of a putter head body, profile lines 66*b* of a fan-shaped background mark 51*b*, and profile lines 66*a* of modified rhombic ring-like mark which is formed inside the background mark 51*b* and is constituted of a pair of blurring marks 45*e* which are arranged to take an oblique posture with respect to an imaginary ball hitting line direction 90 at an address position. On the other hand, in a take-back position and a follow-through position, as shown in FIG. 2, the profile line 66*a* of one blurring mark 45*e* is arranged approximately parallel to the imaginary ball hitting line direction 90 at a take-back position and the profile line 66*a* of another blurring mark 45*e* is arranged approximately parallel to the imaginary ball hitting line direction 90 at a follow-through position.

Accordingly, in the stroking operation of the putter head 2*g*, due to the provision of the blurring marks 45*e*, the longitudinal line mark 31 becomes less conspicuous. Further, the profile line 66*a* of one blurring mark 45*e* is arranged approximately parallel to the imaginary ball hitting line direction 90 at the take-back position and the profile line 66*a* of another blurring mark 45*e* is arranged approximately parallel to the imaginary ball hitting line direction 90 at the follow-through position. Accordingly, a golfer hardly feels the change of the inclination of the longitudinal line mark 31 whereby the putter head can give a sense of smooth and comfortable stroking to the golfer.

Embodiment 3

Figure 6:
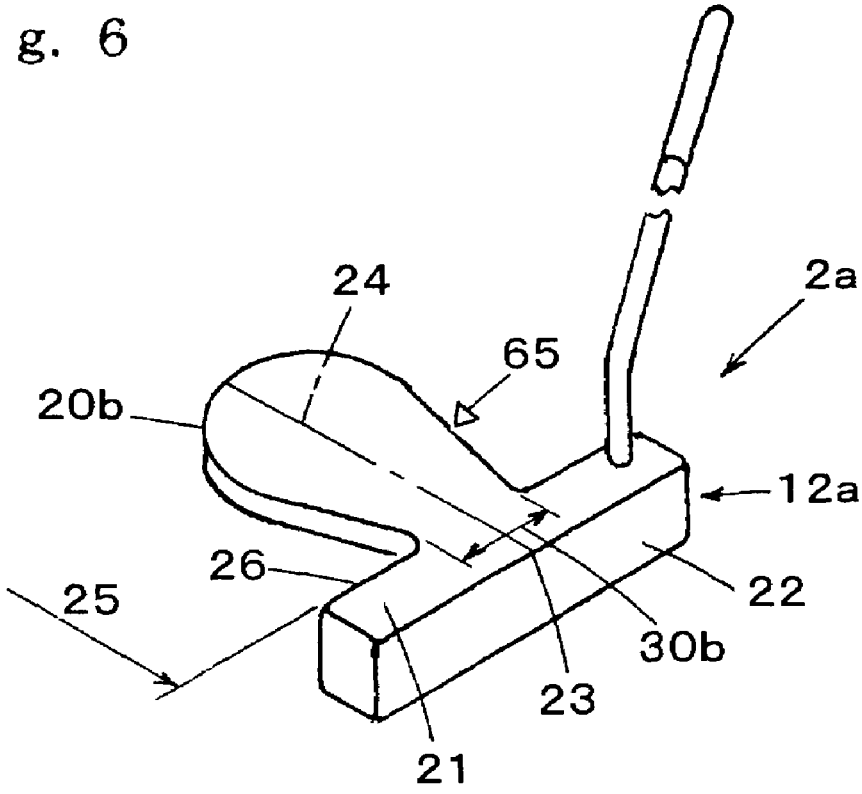
FIG. 6 is a perspective view of a putter head of a third embodiment.

With respect to a putter head 2*a* shown in FIG. 6, a profile shape of an upper surface 21 of a projecting portion 20*b* which is integrally formed on a back surface side 25 of a putter head body 12*a* and extends from a back surface 26 of the putter head body 12*a* has a width thereof increased in the rearward direction and has a semi-circular fan-shaped end portion. Here, the projecting portion 20*b* forms a portion of the putter head body 12*a*. Further, the projecting portion 20*b* is connected with one end 26 of the back surface of the putter head body 12*a* with a lateral width of 30*b*. An imaginary line axis 24 is defined on upper surfaces of the putter head body 12*a* and the projecting portion 20*b* and extends rearwardly from a center (a sweet spot) 23 of the putter face 22 in the direction orthogonal to the putter face 22. In this embodiment, although not shown in the drawing, a longitudinal line mark having a given width is formed on the upper surface and putter head body 12*a* and the projecting portion 20*b* in a state that the longitudinal line mark is overlapped to the imaginary center axis 24. The fan-shaped projecting portion 20*b* is formed symmetrically with respect to the imaginary center axis 24 and hence, both side profile lines of the fan-shaped projecting portion 20*b* constitute blurring marks 65 which are arranged symmetrically and approximately non-parallel to the imaginary center axis 24 at an address position.

Accordingly, in the stroking operation of the putter head 2*a*, due to the provision of the blurring marks 65, the longitudinal line mark becomes less conspicuous. Further, the profile line of one blurring mark 65 is arranged approximately parallel to the imaginary ball hitting line at the take-back position and the profile line of another blurring mark 65 is arranged approximately parallel to the imaginary ball hitting line at the follow-through position. Accordingly, a golfer hardly feels the change of the inclination of the longitudinal line mark whereby the putter head 2*a* can give a sense of smooth and comfortable stroking to the golfer.

Embodiment 4

Figure 7:
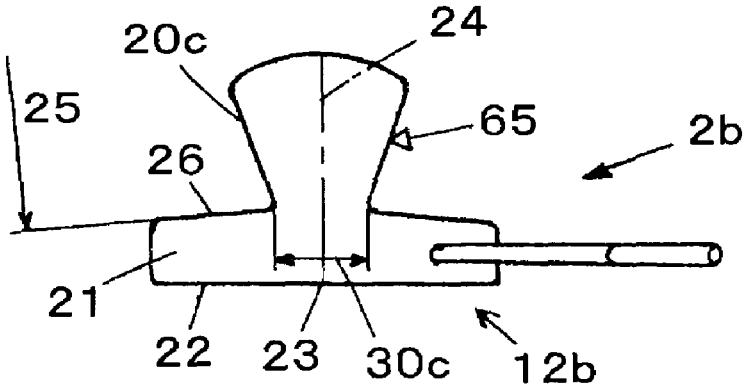
FIG. 7 is a plan view of a putter head of a fourth embodiment.

With respect to a putter head 2*b* shown in FIG. 7, a profile shape of an upper surface 21 of a projecting portion 20*c* which is integrally formed on a back surface side 25 of a putter head body 12*b* and extends from a back surface 26 of the putter head body 12*b* has a width thereof increased in the rearward direction and has a semi-circular fan-shaped end portion. Here, the projecting portion 20*c* forms a portion of the putter head body 12*a*. Further, the projecting portion 20*c* is connected with one end of the back surface 26 of the putter head body 12*b* with a lateral width of 30*c*. An imaginary line axis 24 is defined on upper surfaces of the putter head body 12*b* and the projecting portion 20*c* and extends rearwardly from a center (a sweet spot) 23 of the putter face 22 in the direction orthogonal to the putter face 22. In this embodiment, although not shown in the drawing, a longitudinal line mark having a given width is formed on the upper surface and putter head body 12*b* and the projecting portion 20*c* in a state that the longitudinal line mark is overlapped to the imaginary center axis 24. The fan-shaped projecting portion 20*c* is formed symmetrically with respect to the imaginary center axis 24 and hence, both side profile lines of the fan-shaped projecting portion 20*c* constitute blurring marks 65 which are arranged symmetrically and approximately non-parallel to the imaginary center axis 24 at an address position.

Accordingly, in the stroking operation of the putter head 2*b*, due to the provision of the blurring marks 65, the longitudinal line mark becomes less conspicuous. Further, the profile line of one blurring mark 65 is arranged approximately parallel to the imaginary ball hitting line at the take-back position and the profile line of another blurring mark 65 is arranged approximately parallel to the imaginary ball hitting line at the follow-through position. Accordingly, a golfer hardly feels the change of the inclination of the longitudinal line mark whereby the putter head 2*b* can give a sense of smooth and comfortable stroking to the golfer.

Embodiment 5

Figure 8:
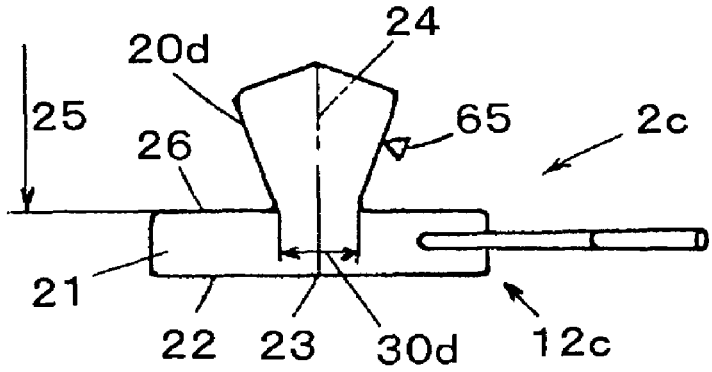
FIG. 8 is a plan view of a putter head of a fifth embodiment.

With respect to a putter head 2*c* shown in FIG. 8, a profile shape of an upper surface 21 of a projecting portion 20*d* which is integrally formed on a back surface side 25 of a putter head body 12*c* and extends from a back surface 26 of the putter head body 12*c* a has a width thereof increased in the rearward direction and has a gentle-mountain-like fan-shaped end portion. Here, the projecting portion 20*d* forms a portion of the putter head body 12*c*. Further, the projecting portion 20*d* is connected with one end of the back surface 26 of the putter head body 12*c* with a lateral width of 30*d*. An imaginary line axis 24 is defined on upper surfaces of the putter head body 12*c* and the projecting portion 20*d* and extends rearwardly from a center (a sweet spot) 23 of the putter face 22 in the direction orthogonal to the putter face 22. In this embodiment, although not shown in the drawing, a longitudinal line mark having a given width is formed on the upper surface and putter head body 12*c* and the projecting portion 20*d* in a state that the longitudinal line mark is overlapped to the imaginary center axis 24. The fan-shaped projecting portion 20*d* is formed symmetrically with respect to the imaginary center axis 24 and hence, both side profile lines of the fan-shaped projecting portion 20*d* constitute blurring marks 65 which are arranged symmetrically and approximately non-parallel to the imaginary center axis 24 at an address position.

Accordingly, in the stroking operation of the putter head 2*c*, due to the provision of the blurring marks 65, the longitudinal line mark becomes less conspicuous. Further, the profile line of one blurring mark 65 is arranged approximately parallel to the imaginary ball hitting line at the take-back position and the profile line of another blurring mark 65 is arranged approximately parallel to the imaginary ball hitting line at the follow-through position. Accordingly, a golfer hardly feels the change of the inclination of the longitudinal line mark whereby the putter head 2*c* can give a sense of smooth and comfortable stroking to the golfer.

Still further, the profile shape of the projecting portion 20*d* which extends from the back surface 26 of the putter head body 12*c* and the blurring marks 65 have the widths thereof increased in the rearward direction and hence, the putter head 2*c* can be formed in a compact shape.

Embodiment 6

Figure 9:
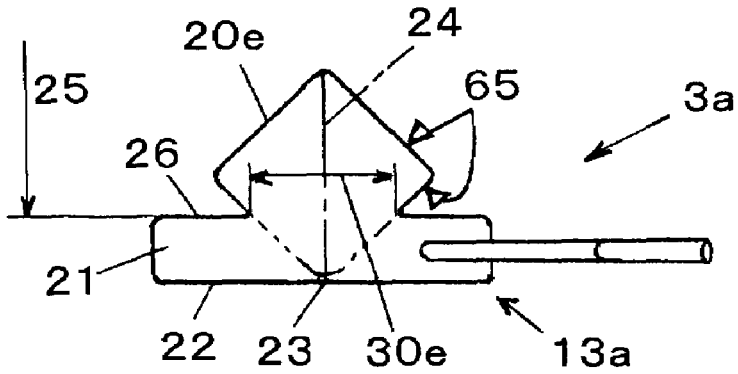
FIG. 9 is a plan view of a putter head of a sixth embodiment.

With respect to a putter head 3*a* shown in FIG. 9, a profile shape of an upper surface 21 of a projecting portion 20*e* which is integrally formed on a back surface side 25 of a putter head body 13*a* of the putter head 3*a* and extends from a back surface 26 of the putter head body 13*a* is formed of a modified quadrangular shape having diagonal lines which cross each other orthogonally, wherein the modified quadrangular shape has three corners and a lateral width 30*e* in the direction orthogonal to the diagonal line extending in the longitudinal direction. The projecting portion 20*e* forms a portion of the putter head body 13*a*. Further, the projecting portion 20*e* is connected with one end of the back surface 26 of the putter head body 13*a* with the lateral width of 30*e*. An imaginary line axis 24 is defined on upper surfaces of the putter head body 13*a* and the projecting portion 20*e* and extends rearwardly from a center (a sweet spot) 23 of the putter face 22 in the direction orthogonal to the putter face 22 and the diagonal line of the above-mentioned modified quadrangle is overlapped to the imaginary line axis 24. In this embodiment, although not shown in the drawing, a longitudinal line mark having a given width is formed on the upper surface and putter head body 13*a* and the projecting portion 20*e* in a state that the longitudinal line mark is overlapped to the longitudinally extending imaginary line axis 24. Accordingly, both side profile lines of the quadrangular projecting portion 20*e* constitute blurring marks 65 which are arranged symmetrically and approximately non-parallel to the imaginary center axis 24 at an address position.

Accordingly, in the stroking operation of the putter head 3*a*, due to the provision of the blurring marks 65, the longitudinal line mark becomes less conspicuous. Further, one profile lines of both blurring marks 65 are arranged approximately parallel to the imaginary ball hitting line at the take-back position and another profile lines of both blurring marks 65 are arranged approximately parallel to the imaginary ball hitting line at the follow-through position. Accordingly, a golfer hardly feels the change of the inclination of the longitudinal line mark whereby the putter head 3*a* can give a sense of smooth and comfortable stroking to the golfer.

Embodiment 7

Figure 10:
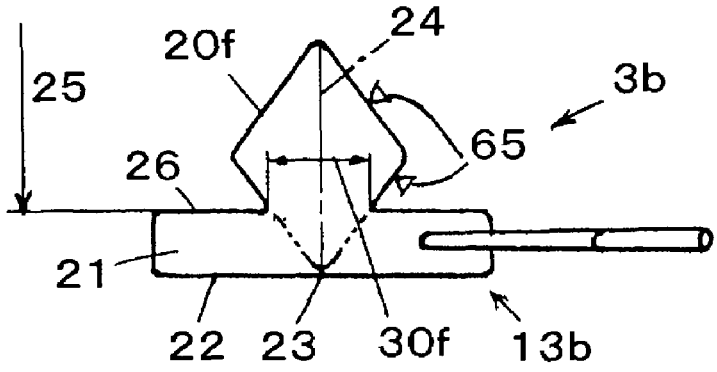
FIG. 10 is a plan view of a putter head of a seventh embodiment.

With respect to a putter head 3*b* shown in FIG. 10, a profile shape of an upper surface 21 of a projecting portion 20*f* is integrally formed on a back surface side 25 of a putter head body 13*b* of the putter head 3*b* and extends from a back surface 26 of the putter head body 13*b* is formed of a modified rhombic shape having diagonal lines which cross each other orthogonally, wherein the modified quadrangular shape has three corners and a lateral width 30*f* in the direction orthogonal to the elongated diagonal line extending in the longitudinal direction. The projecting portion 20*f* forms a portion of the putter head body 13*b*. Further, the projecting portion 20*f* is connected with one end 26 of the back surface of the putter head body 13*b* with the lateral width of 30*f*. An imaginary line axis 24 is defined on upper surfaces of the putter head body 13*b* and the projecting portion 20*f* and extends rearwardly from a center (a sweet spot) 23 of the putter face 22 in the direction orthogonal to the putter face 22 and the elongated diagonal line of the above-mentioned modified rhombic shape is overlapped to the imaginary line axis 24. In this embodiment, although not shown in the drawing, a longitudinal line mark having a given width is formed on the upper surface and putter head body 13*b* and the projecting portion 20*f* in a state that the longitudinal line mark is overlapped to the longitudinally extending imaginary line axis 24. Accordingly, both side profile lines of the rhombic projecting portion 20*f* constitute blurring marks 65 which are arranged symmetrically and approximately non-parallel to the imaginary center axis 24 at an address position.

Accordingly, in the stroking operation of the putter head 3*a*, due to the provision of the blurring marks 65, the longitudinal line mark becomes less conspicuous. Further, one profile lines of both blurring marks 65 are arranged approximately parallel to the imaginary ball hitting line at the take-back position and another profile lines of both blurring marks 65 are arranged approximately parallel to the imaginary ball hitting line at the follow-through position. Accordingly, a golfer hardly feels the change of the inclination of the longitudinal line mark whereby the putter head 3*b* can give a sense of smooth and comfortable stroking to the golfer.

Embodiment 8

Figure 11:
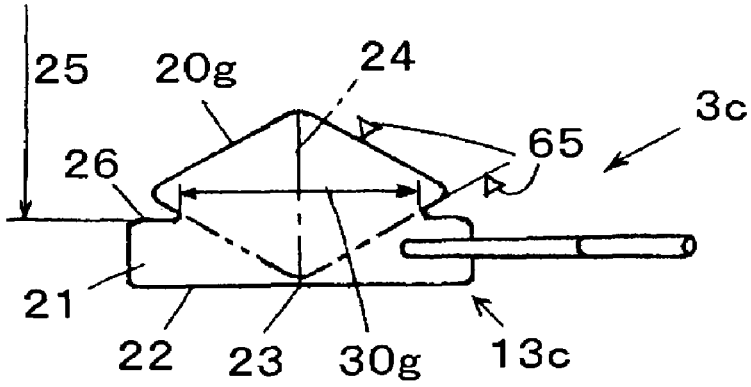
FIG. 11 is a plan view of a putter head of an eighth embodiment.

With respect to a putter head 3*c* shown in FIG. 11, a profile shape of an upper surface 21 of a projecting portion 20*g* is integrally formed on a back surface side 25 of a putter head body 13*c* of the putter head 3*c*, extends from a back surface 26 of the putter head body 13*c* and is formed of a modified rhombic shape having diagonal lines which cross each other orthogonally, wherein the modified quadrangular shape has three corners and a lateral width 30*g* in the direction orthogonal to the shortened diagonal line extending in the longitudinal direction. The projecting portion 20*g* forms a portion of the putter head body 13*c*. Further, the projecting portion 20*g* is connected with one end of the back surface 26 of the putter head body 13*c* with the lateral width of 30*g*. An imaginary line axis 24 is defined on upper surfaces of the putter head body 13*c* and the projecting portion 20*g* and extends rearwardly from a center (a sweet spot) 23 of the putter face 22 in the direction orthogonal to the putter face 22 and the shortened diagonal line of the above-mentioned modified rhombic shape is overlapped to the imaginary line axis 24. In this embodiment, although not shown in the drawing, a longitudinal line mark having a given width is formed on the upper surface and putter head body 13*c* and the projecting portion 20*g* in a state that the longitudinal line mark is overlapped to the longitudinally extending imaginary line axis 24. Accordingly, both side profile lines of the rhombic projecting portion 20*g* constitute blurring marks 65 which are arranged symmetrically and approximately non-parallel to the imaginary center axis 24 at an address position.

Accordingly, in the stroking operation of the putter head 3*c*, due to the provision of the blurring marks 65, the longitudinal line mark becomes less conspicuous. Further, one profile lines of both blurring marks 65 are arranged approximately parallel to the imaginary ball hitting line at the take-back position and another profile lines of both blurring marks 65 are arranged approximately parallel to the imaginary ball hitting line at the follow-through position. Accordingly, a golfer hardly feels the change of the inclination of the longitudinal line mark whereby the putter head 3*c* can give a sense of smooth and comfortable stroking to the golfer.

Embodiment 9

Figure 12:
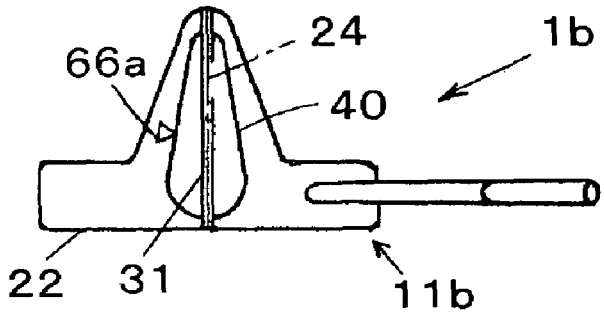
FIG. 12 is a plan view of a putter head of a ninth embodiment.

With respect to a putter head 1*b* shown in FIG. 12, a longitudinal mark 40 which decreases a lateral width thereof in the direction toward a back surface distal-end side from a large lateral width on a putter face 22 side of a putter head body 11*b* is formed on an imaginary line axis 24, and a fine strip-like longitudinal line mark 31 which extends a whole longitudinal length of the putter head body 11*b* is formed in a state that the longitudinal line mark 31 splits the longitudinal mark 40. Accordingly, both side profiles of longitudinal mark 40 constitute blurring marks 66*a* which are arranged symmetrically and approximately non-parallel to the strip-like longitudinal line mark 31 at an address position.

Accordingly, in the stroking operation of the putter head 1*b*, due to the provision of the blurring marks 66*a*, the longitudinal line mark 31 becomes less conspicuous. Further, the profile line of one blurring mark 66*a* is arranged approximately parallel to the imaginary ball hitting line at the take-back position and the profile line of another blurring mark 66*a* is arranged approximately parallel to the imaginary ball hitting line at the follow-through position. Accordingly, a golfer hardly feels the change of the inclination of the longitudinal line mark whereby the putter head 1*b* can give a sense of smooth and comfortable stroking to the golfer.

Embodiment 10

Figure 13:
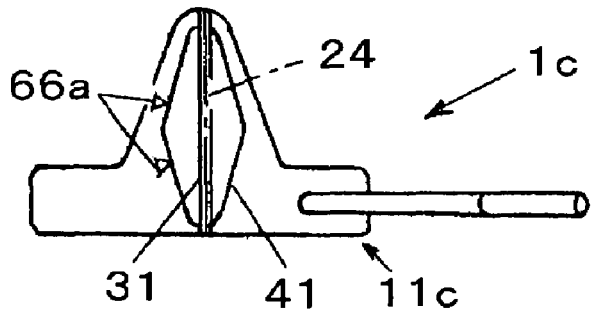
FIG. 13 is a plan view of a putter head of a tenth embodiment.

With respect to a putter head 1*c* shown in FIG. 13, a longitudinal mark 41 which increases a lateral width thereof toward a center side from both front and rear ends of a putter head body 11*c* is formed on an imaginary line axis 24, and a fine strip-like longitudinal line mark 41 which extends a whole longitudinal length of the putter head body 11*c* is formed in a state that the longitudinal line mark 41 splits the longitudinal mark 41. Accordingly, both side profiles of longitudinal mark 41 constitute blurring marks 66*a* which are arranged symmetrically and approximately non-parallel to the strip-like longitudinal line mark 31 at an address position.

Accordingly, in the stroking operation of the putter head 1*c*, due to the provision of the blurring marks 66*a*, the longitudinal line mark 31 becomes less conspicuous. Further, the profile line of one blurring mark 66*a* is arranged approximately parallel to the imaginary ball hitting line at the take-back position and the profile line of another blurring mark 66*a* is arranged approximately parallel to the imaginary ball hitting line at the follow-through position. Accordingly, a golfer hardly feels the change of the inclination of the longitudinal line mark whereby the putter head 1*c* can give a sense of smooth and comfortable stroking to the golfer.

Embodiment 11

Figure 14:
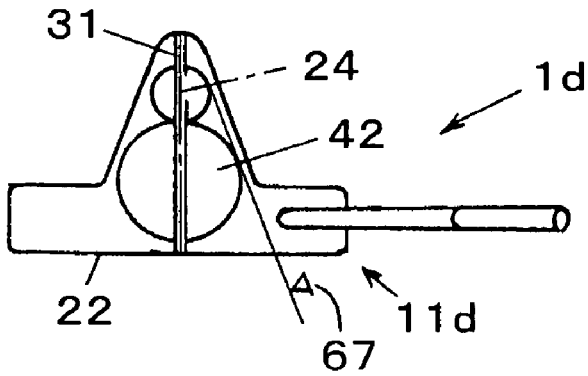
FIG. 14 is a plan view of a putter head of an eleventh embodiment.

With respect to a putter head 1*d* shown in FIG. 14, a circular mark 42 which is constituted of a large circular shape on a putter face 22 side of a putter head body 11*d* and a small circular shape on a rear distal end side of the putter head body 11*d* is formed on an imaginary line axis 24, and a fine strip-like longitudinal line mark 31 which extends a whole longitudinal length of the putter head body 11*d* is formed in a state that the longitudinal line mark 31 splits the circular mark 42. Accordingly, both tangential lines which connect circumferences of large and small circular shapes constitute blurring marks 67 which are arranged symmetrically and approximately non-parallel to the strip-like longitudinal line mark 31 at an address position.

Accordingly, in the stroking operation of the putter head 1*d*, due to the provision of the blurring marks 67, the longitudinal line mark 31 becomes less conspicuous. Further, the profile line of one blurring mark 67 is arranged approximately parallel to the imaginary ball hitting line at the take-back position and the profile line of another blurring mark 67 is arranged approximately parallel to the imaginary ball hitting line at the follow-through position. Accordingly, a golfer hardly feels the change of the inclination of the longitudinal line mark whereby the putter head 1*d* can give a sense of smooth and comfortable stroking to the golfer.

Embodiment 12

Figure 15:
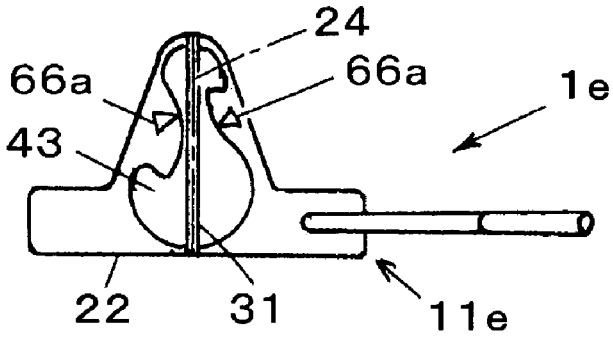
FIG. 15 is a plan view of a putter head of a twelfth embodiment.

With respect to a putter head 1*e* shown in FIG. 15, a bold S-shaped mark 43 which decreases a lateral width from a putter face 22 side to rear distal end side of a putter head body 11*e* is formed on an imaginary line axis 24, and a fine strip-like longitudinal line mark 31 which extends a whole longitudinal length of the putter head body 11*e* is formed in a state that the longitudinal line mark 31 splits the S-shaped mark 43. Accordingly, both-side profile lines of the S-shaped mark 43 which constitute blurring marks 66*a* are arranged symmetrically and approximately non-parallel to the strip-like longitudinal line mark 31 at an address position.

Accordingly, in the stroking operation of the putter head 1*e*, due to the provision of the blurring marks 66*a*, the longitudinal line mark 31 becomes less conspicuous. Further, the profile line of one blurring mark 66*a* is arranged approximately parallel to the imaginary ball hitting line at the take-back position and the profile line of another blurring mark 66*a* is arranged approximately parallel to the imaginary ball hitting line direction at the follow-through position. Accordingly, a golfer hardly feels the change of the inclination of the longitudinal line mark 31 whereby the putter head 1*e* can give a sense of smooth and comfortable stroking to the golfer.

Embodiment 13

Figure 16:
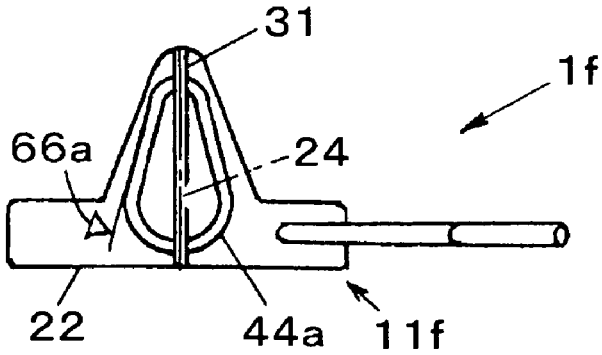
FIG. 16 is a plan view of a putter head of a thirteenth embodiment.

With respect to a putter head 1*f* shown in FIG. 16, a fan-shaped ring-like mark 44*a* which has a fixed large line width decreases a lateral width thereof from a putter face 22 side to rear distal end side of a putter head body 22 is formed on an imaginary line axis 24, and a fine strip-like longitudinal line mark 31 which extends a whole longitudinal length of the putter head body 11*f* is formed in a state that the longitudinal line mark 31 splits the ring-like mark 44*a*. Accordingly, both-side profile lines of the ring-like mark 44*a* which constitute blurring marks 66*a* are arranged symmetrically and approximately non-parallel to the strip-like longitudinal line mark 31 at an address position.

Accordingly, in the stroking operation of the putter head 1*f*, due to the provision of the blurring marks 66*a*, the longitudinal line mark 31 becomes less conspicuous. Further, the profile line of one side of the blurring mark 66*a* is arranged approximately parallel to the imaginary ball hitting line direction at the take-back position and the profile line of another side of the blurring mark 66*a* is arranged approximately parallel to the imaginary ball hitting line direction at the follow-through position. Accordingly, a golfer hardly feels the change of the inclination of the longitudinal line mark whereby the putter head if can give a sense of smooth and comfortable stroking to the golfer.

Embodiment 14

Figure 17:
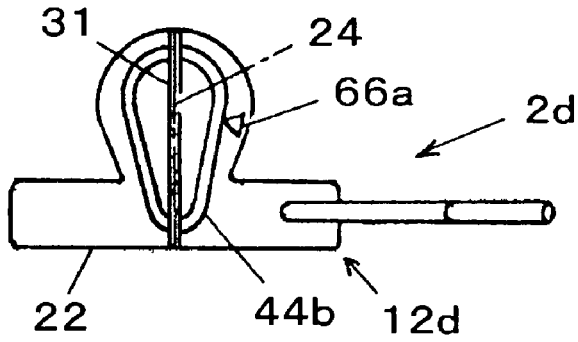
FIG. 17 is a plan view of a putter head of a fourteenth embodiment.

With respect to a putter head 2*d* shown in FIG. 17, a fan-shaped ring-like mark 44*b* which has a fixed bold line width increases a lateral width thereof from a putter face 22 side to rear distal end side of a putter head body 12*d* is formed on an imaginary line axis 24, and a fine strip-like longitudinal line mark 31 which extends a whole longitudinal length of the putter head body 12*d* is formed in a state that the longitudinal line mark 31 splits the ring-like mark 44*b*. Accordingly, both-side profile lines of the ring-like mark 44*b* which constitute blurring marks 66*a* are arranged symmetrically and approximately non-parallel to the strip-like longitudinal line mark 31 at an address position.

Accordingly, in the stroking operation of the putter head 2*d*, due to the provision of the blurring marks 66*a*, the longitudinal line mark 31 becomes less conspicuous. Further, the profile line of one side of the blurring mark 66*a* is arranged approximately parallel to the imaginary ball hitting line direction at the take-back position and the profile line of another side of the blurring mark 66*a* is arranged approximately parallel to the imaginary ball hitting line direction at the follow-through position. Accordingly, a golfer hardly feels the change of the inclination of the longitudinal line mark whereby the putter head 2*d* can give a sense of smooth and comfortable stroking to the golfer.

Embodiment 15

Figure 18:
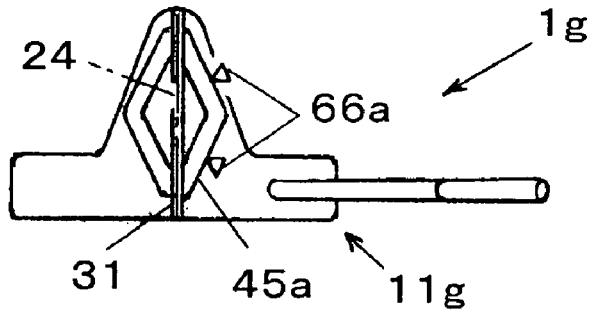
FIG. 18 is a plan view of a putter head of a fifteenth embodiment.

With respect to a putter head 1*g* shown in FIG. 18, a longitudinal rhombic ring-like mark 45*a* which has a bold line width is formed on an imaginary line axis 24, and a fine strip-like longitudinal line mark 31 which extends a whole longitudinal length of the putter head body 11*g* is formed in a state that the longitudinal line mark 31 splits the longitudinal ring-like mark 45*a*. Accordingly, both side profiles of longitudinal ring-like mark 45*a* constitute blurring marks 66*a* which are arranged symmetrically and approximately non-parallel to the strip-like longitudinal line mark 31 at an address position.

Accordingly, in the stroking operation of the putter head 1*g*, due to the provision of the blurring marks 66*a*, the longitudinal line mark 31 becomes less conspicuous. Further, the profile line of one blurring mark 66*a* is arranged approximately parallel to the imaginary ball hitting line direction at the take-back position and the profile line of another blurring mark 66*a* is arranged approximately parallel to the imaginary ball hitting line direction at the follow-through position. Accordingly, a golfer hardly feels the change of the inclination of the longitudinal line mark whereby the putter head 1*g* can give a sense of smooth and comfortable stroking to the golfer.

Embodiment 16

Figure 19:
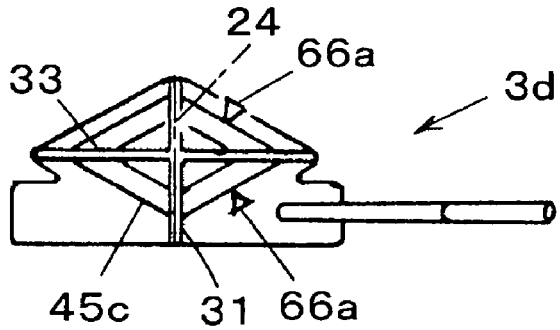
FIG. 19 is a plan view of a putter head of a sixteenth embodiment.

With respect to a putter head 3*d* shown in FIG. 19 which constitutes a modification of the putter head 3*c* shown in FIG. 11, a laterally elongated rhombic ring-like mark 45*c* which has a bold line width is formed on an imaginary line axis 24, and a fine strip-like longitudinal line mark 31 which extends on the imaginary line axis 24 and a lateral line 33 are formed on diagonal lines of the ring-like mark 45*c* which cross each other in a state that the longitudinal line mark 31 and the lateral line 33 split the ring-like mark 45*c* in four. Accordingly, both side profiles of longitudinal ring-like mark 45*c* constitute blurring marks 66*a* which are arranged symmetrically and approximately non-parallel to the strip-like longitudinal line mark 31 at an address position.

Accordingly, in the stroking operation of the putter head 3*d*, due to the provision of the blurring marks 66*a*, the longitudinal line mark 31 becomes less conspicuous. Further, the profile line of one blurring mark 66*a* is arranged approximately parallel to the imaginary ball hitting line at the take-back position and the profile line of another blurring mark 66*a* is arranged approximately parallel to the imaginary ball hitting line at the follow-through position. Accordingly, a golfer hardly feels the change of the inclination of the longitudinal line mark whereby the putter head 3*d* can give a sense of smooth and comfortable stroking to the golfer. Further, due to the provision of the longitudinal line mark 31 and the lateral line which cross each other orthogonally, the alignment of the putter head 3*d* with the imaginary ball hitting line is facilitated.

Embodiment 17

Figure 20:
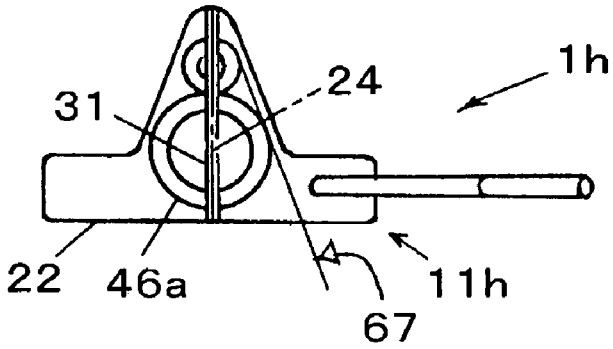
FIG. 20 is a plan view of a putter head of a seventeenth embodiment.

With respect to a putter head 1*h* shown in FIG. 20, a ring-like mark 46*a* which is constituted of a large circular shape having a fixed bold line width on a putter face 22 side of a putter head body 11*h* and a small circular shape having a bold line width on a rear distal end side of the putter head body 11*h* is formed on an imaginary line axis 24, and a fine strip-like longitudinal line mark 31 which extends a whole longitudinal length of the putter head body 11*h* is formed in a state that the longitudinal line mark 31 splits the ring-like mark 46*a*. Accordingly, both tangential lines which connect circumferences of large and small circular shapes constitute blurring marks 67 which are arranged symmetrically and approximately non-parallel to the strip-like longitudinal line mark 31 at an address position.

Accordingly, in the stroking operation of the putter head 1*h*, due to the provision of the blurring marks 67, the longitudinal line mark 31 becomes less conspicuous. Further, the profile line of one blurring mark 67 is arranged approximately parallel to the imaginary ball hitting line direction at the take-back position and the profile line of another blurring mark 67 is arranged approximately parallel to the imaginary ball hitting line direction at the follow-through position. Accordingly, a golfer hardly feels the change of the inclination of the longitudinal line mark whereby the putter head 1*h* can give a sense of smooth and comfortable stroking to the golfer.

Embodiment 18

With respect to a putter head 2*f* shown in FIG. 21 which constitutes a modification of the putter head 2*a* shown in FIG. 6, a ring-like mark 46*b* which is constituted of a small elliptical shape having a fixed bold line width on a putter face 22 side of a putter head body 12*f* and a large elliptical shape having a bold line width on a rear distal end side of the putter head body 12*f* is formed on an imaginary line axis 24, and a fine strip-like longitudinal line mark 31 which extends a whole longitudinal length of the putter head body 12*f* is formed in a state that the longitudinal line mark 31 splits the ring-like mark 46*b*. Accordingly, both tangential lines which connect circumferences of large and small circular shapes constitute blurring marks 67 which are arranged symmetrically and approximately non-parallel to the strip-like longitudinal line mark 31 at an address position.

Accordingly, in the stroking operation of the putter head 2*f*, due to the provision of the blurring marks 67, the longitudinal line mark 31 becomes less conspicuous. Further, the profile line of one blurring mark 67 is arranged approximately parallel to the imaginary ball hitting line direction at the take-back position and the profile line of another blurring mark 67 is arranged approximately parallel to the imaginary ball hitting line direction at the follow-through position. Accordingly, a golfer hardly feels the change of the inclination of the longitudinal line mark whereby the putter head 2*f* can give a sense of smooth and comfortable stroking to the golfer.

Embodiment 19

With respect to a putter head 2*g* shown in FIG. 22 which constitutes a modification of the putter head 2*c* shown in FIG. 8, V-shaped blurring marks 47 which have a fixed bold line width and symmetrically increase a lateral width thereof from a putter face 22 side to a rear side of a putter head body 21 with respect to an imaginary line axis 24 and small spot marks 50 which have a given shape are arranged on both sides of the line axis 24 at the rear end side of the putter head body 21 in a state that the spot marks 50 sandwich the imaginary line axis 24. On the line axis 24 which becomes the center in the longitudinal direction with respect to the respective marks V-shaped blurring marks 47, a fine strip-like longitudinal line mark 31 is formed in a state that the longitudinal line mark 31 splits the V-shaped blurring marks 47. Further, a fine strip-like lateral line 32 is formed along and adjacent to a putter face 22 on an upper surface of the putter head body to form the putter 2*g* provided with a T-shaped mark. Accordingly, both profile lines 66*a* of the V-shaped blurring marks 47 are arranged symmetrically and approximately non-parallel to the strip-like longitudinal line mark 31 at an address position. Further, since the V-shaped blurring marks 47 which have the fixed bold line has a line width larger than a line width of the fine strip-like lateral line 32, the V-shaped blurring marks 47 become more conspicuous.

Accordingly, in the stroking operation of the putter head 2*g*, due to the provision of the V-shaped blurring marks 47, the longitudinal line mark 31 becomes less conspicuous. Further, the profile line 66*a* of one V-shaped blurring mark 47 is arranged approximately parallel to the imaginary ball hitting line at the take-back position and the profile line 66*a* of another V-shaped blurring mark 47 is arranged approximately parallel to the imaginary ball hitting line at the follow-through position. Accordingly, a golfer hardly feels the change of the inclination of the longitudinal line mark 31 whereby the putter head 2*g* can give a sense of smooth and comfortable stroking to the golfer.

Further, an inventor of the present invention has found that when the rearend of each blurring mark 47 becomes excessively remote from the longitudinal line mark 31, the blurring effect is decreased. The spot marks 50 are provided for preventing such decrease of the blurring-effect.

Embodiment 20

Figure 23:
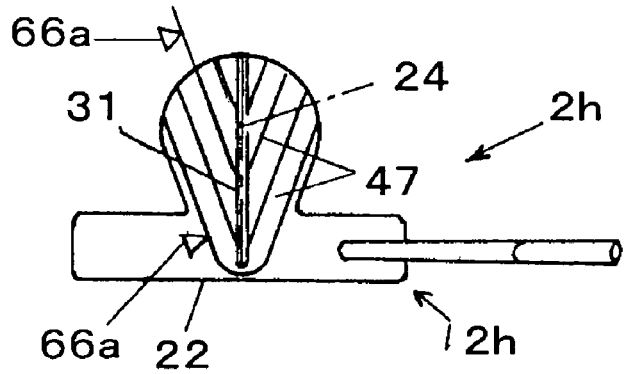
FIG. 23 is a plan view of a putter head of a twentieth embodiment.

With respect to a putter head 2*h* shown in FIG. 23 which constitutes a modification of the putter head 2*a* shown in FIG. 6, a plurality of V-shaped marks 47 which have a fixed bold line width and increase widths thereof toward a rear side from a putter face 22 side on the imaginary line axis 24 are formed, and a fine strip-like longitudinal line mark 31 which extends a whole longitudinal length of the putter head body 2*h* is formed in on an imaginary line axis 24 which constitutes the center of the V-shaped marks 47 in a state that the longitudinal line mark 31 splits the V-shaped marks 47. Accordingly, profile lines of the V-shaped marks 47 constitute blurring marks 66*a* which are arranged symmetrically and approximately non-parallel to the strip-like longitudinal line mark 31 at an address position.

Accordingly, in the stroking operation of the putter head 2*h*, due to the provision of the blurring marks 66*a*, the longitudinal line mark 31 becomes less conspicuous. Further, the profile line of one blurring mark 66*a* is arranged approximately parallel to the imaginary ball hitting line at the take-back position and the profile line of another blurring mark 66*a* is arranged approximately parallel to the imaginary ball hitting line at the follow-through position. Accordingly, a golfer hardly feels the change of the inclination of the longitudinal line mark whereby the putter head 2*h* can give a sense of smooth and comfortable stroking to the golfer.

Embodiment 21

Figure 24:
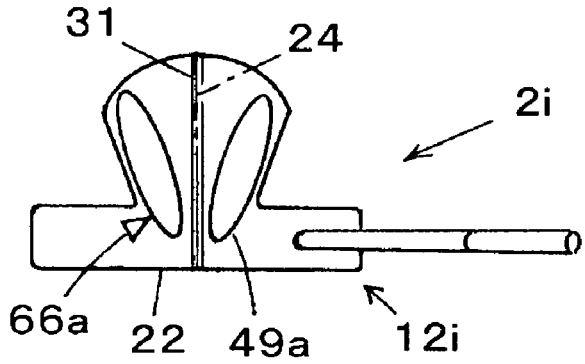
FIG. 24 is a plan view of a putter head of a twenty-first embodiment.

With respect to a putter head 2*i* shown in FIG. 24 which constitutes a modification of the putter head 2*b* shown in FIG. 7, a chevron-shaped mark 49*a* which has a given bold line width and increases a lateral width thereof from a putter face 22 side to a rear side of a putter head body 12*i* to form an inverse chevron shape while sandwiching an imaginary line axis 24 is formed on the putter head body 12*i*, and a fine strip-like longitudinal line mark 31 which extends a whole longitudinal length of the putter head body 12*i* is formed on the line axis 24 which constitutes the center of the mark 49*a*. Accordingly, profile lines of the chevron shape 49*a* constitute blurring marks 66*a* which are arranged symmetrically and approximately non-parallel to the strip-like longitudinal line mark 31 at an address position.

Accordingly, in the stroking operation of the putter head 2*h*, due to the provision of the blurring marks 66*a*, the longitudinal line mark 31 becomes less conspicuous. Further, the profile line of one blurring mark 66*a* is arranged approximately parallel to the imaginary ball hitting line at the take-back position and the profile line of another blurring mark 66*a* is arranged approximately parallel to the imaginary ball hitting line at the follow-through position. Accordingly, a golfer hardly feels the change of the inclination of the longitudinal line mark whereby the putter head 2*i* can give a sense of smooth and comfortable stroking to the golfer.

Embodiment 22

Figure 25:
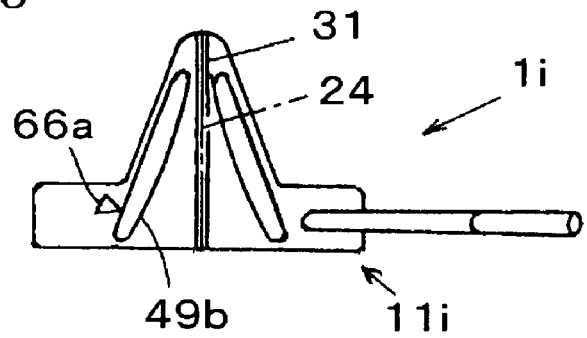
FIG. 25 is a plan view of a putter head of a twenty-second embodiment.

With respect to a putter head 1*i* shown in FIG. 25, a chevron-shaped mark 49*b* which has a given bold line width and increases a lateral width thereof from a rear side to a putter face 22 side of a putter head body 11*i* to form a chevron shape while sandwiching an imaginary line axis 24 is formed on the putter head body 11*i*, and a fine strip-like longitudinal line mark 31 which extends a whole longitudinal length of the putter head body 11*i* is formed on the line axis 24 which constitutes the center of the mark 49*a*. Accordingly, profile lines of the chevron shape 49*b* constitute blurring marks 66*a* which are arranged symmetrically and approximately non-parallel to the strip-like longitudinal line mark 31 at an address position.

Accordingly, in the stroking operation of the putter head 1*i*, due to the provision of the blurring marks 66*a*, the longitudinal line mark 31 becomes less conspicuous. Further, the profile line of one blurring mark 66*a* is arranged approximately parallel to the imaginary ball hitting line at the take-back position and the profile line of another blurring mark 66*a* is arranged approximately parallel to the imaginary ball hitting line at the follow-through position. Accordingly, a golfer hardly feels the change of the inclination of the longitudinal line mark whereby the putter head 1*i* can give a sense of smooth and comfortable stroking to the golfer.

Embodiment 23

Embodiments 23 to 37 which are described hereinafter in conjunction with FIG. 26 to FIG. 41 are characterized by using a background mark in addition to the blurring mark.

Figure 26:
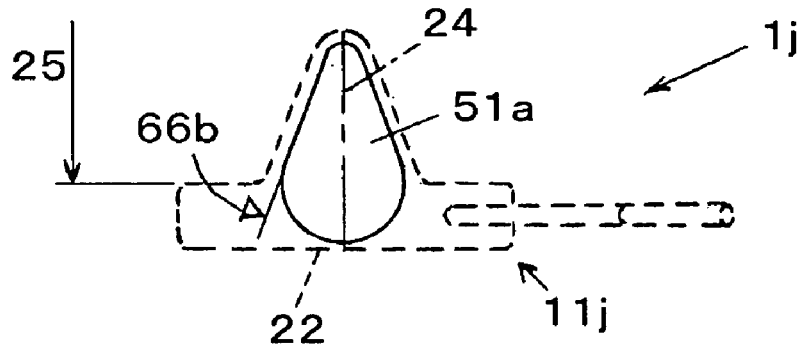
FIG. 26 is a plan view of a putter head of a twenty-third embodiment.

That is, in FIG. 26, a fan-shaped background mark 51*a* which gradually increases a lateral width thereof toward a putter face 22 side from a rear distal end portion of a putter head body 11*j* symmetrically with respect to an imaginary line axis 24 and has a semi-circular portion on the putter face 22 side is formed on the putter head body 11*j*, and a profile shape 66*b* of the background mark 51*a* on a back surface side 25 forms a shape which conforms to a profile shape of the back surface side 25 of the putter head body 11*j*. On this fan-shaped background mark 51*a*, the above-mentioned any blurring mark is formed by printing, coating, etching and the like thus forming a putter head 1*j*. Due to such a constitution, it is possible to make a color of the fan-shaped background mark 51*a* different from a color of the blurring mark and a color of the putter head body 11*j*. In this case, the blurring mark becomes more conspicuous and hence, in the stroking operation of the putter head 1*j*, due to the provision of the blurring mark, the longitudinal line mark becomes less conspicuous. Accordingly, a golfer hardly feels the change of the inclination of the longitudinal line mark whereby the putter head 1*j* can give a sense of smooth and comfortable stroking to the golfer.

Embodiment 24

Figure 27:
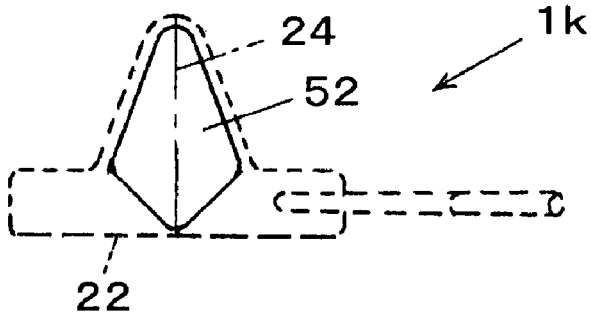
FIG. 27 is a plan view of a putter head of a twenty-fourth embodiment.

FIG. 27 shows a putter head 1*k* which is a modification of the putter head 1*i* shown in FIG. 26. That is, a fan-shaped background mark 52 which is formed symmetrically with respect to an imaginary line axis 24 and has a mountain-like shape on a putter face 22 side and, thereafter, the above-mentioned blurring mark is formed on the background mark 24 by printing, coating, etching and the like thus forming the putter head 1*k*. Due to such a constitution, it is possible to make a color of the fan-shaped background mark 52 different from a color of the blurring mark and a color of the putter head body. In this case, the blurring mark becomes more conspicuous and hence, in the stroking operation of the putter head 1*k*, due to the provision of the blurring mark, the longitudinal line mark becomes less conspicuous. Accordingly, a golfer hardly feels the change of the inclination of the longitudinal line mark whereby the putter head 1*k* can give a sense of smooth and comfortable stroking to the golfer.

Embodiment 25

Figure 28:
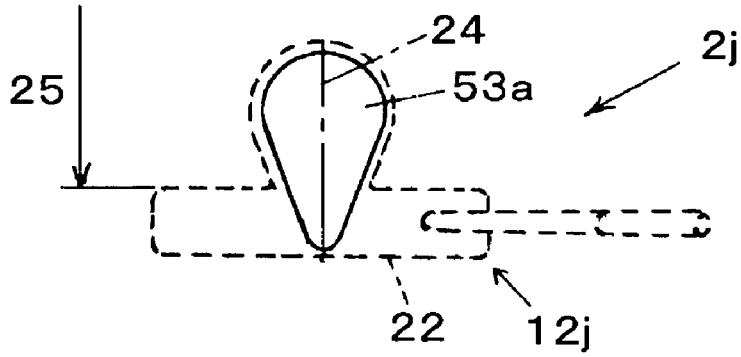
FIG. 28 is a plan view of a putter head of a twenty-fifth embodiment.

FIG. 28 shows a putter head 2*j* which is a modification of the putter head 2*a* shown in FIG. 6. That is, a fan-shaped background mark 53*a* which is formed on a putter head body 12*j* symmetrically while sandwiching an imaginary line axis 24 increases a lateral width thereof toward a rear end side from a putter face 22 side and a profile shape of the background mark 53*a* on the back end side is formed in semi-circular arcuate shape which conforms to a profile shape of the back end side 25 of the putter head body 12*j* thus forming the putter head 2*j*. Due to such a constitution, it is possible to make a color of the fan-shaped background mark 53*a* different from a color of the blurring mark and a color of the putter head body 12*j*. Accordingly, a golfer hardly feels the change of the inclination of the longitudinal line mark whereby the putter head 1*i* can give a sense of smooth and comfortable stroking to the golfer.

Embodiment 26

Figure 29:
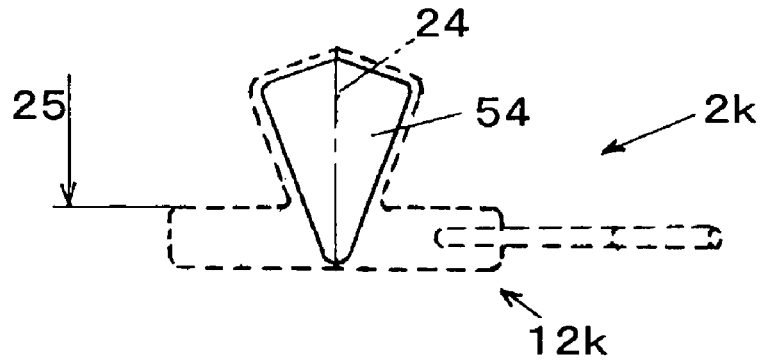
FIG. 29 is a plan view of a putter head of a twenty-sixth embodiment.

FIG. 29 shows a putter head 2*k* which is a modification of the putter head 2*j* shown in FIG. 28. That is, a fan-shaped background mark 54 which is formed on a putter head body 12*k* symmetrically while sandwiching an imaginary line axis 24 increases a lateral width thereof toward a rear end side from a putter face 22 side and a profile shape of the background mark 54 on the back surface side is formed in mountain-like shape which conforms to a profile shape of the back surface side 25 of the putter head body 12*k* thus forming the putter head 2*k*. Due to such a constitution, it is possible to make a color of the fan-shaped background mark 54 different from a color of the blurring mark and a color of the putter head body 12*k*. Accordingly, a golfer hardly feels the change of the inclination of the longitudinal line mark whereby the putter head 2*k* can give a sense of smooth and comfortable stroking to the golfer.

Embodiment 27

Figure 30:
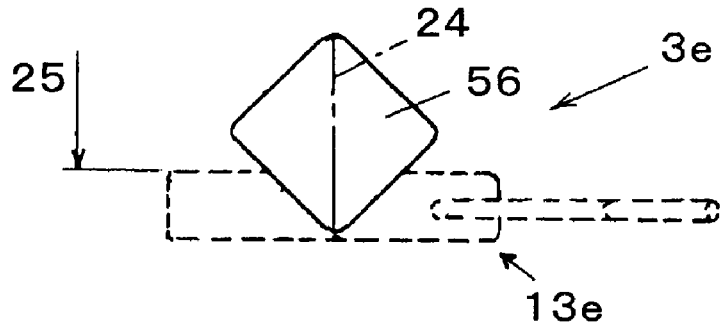
FIG. 30 is a plan view of a putter head of a twenty-seventh embodiment.

FIG. 30 shows a putter head 3*e* which is a modification of the putter head 3*a* shown in FIG. 9. That is, a quadrangular background mark 56 which is formed symmetrically while sandwiching an imaginary line axis 24 therebetween has a portion of a profile shape thereof formed in the same shape as a profile shape of the putter head body 13*e* on a back surface side 25 thus forming the putter head 3*e*. Due to such a constitution, it is possible to make a color of the quadrangular background mark 56 different from a color of the blurring mark and a color of the putter head body 12*k*. Accordingly, a golfer hardly feels the change of the inclination of the longitudinal line mark whereby the putter head 3*e* can give a sense of smooth and comfortable stroking to the golfer.

Embodiment 28

Figure 31:
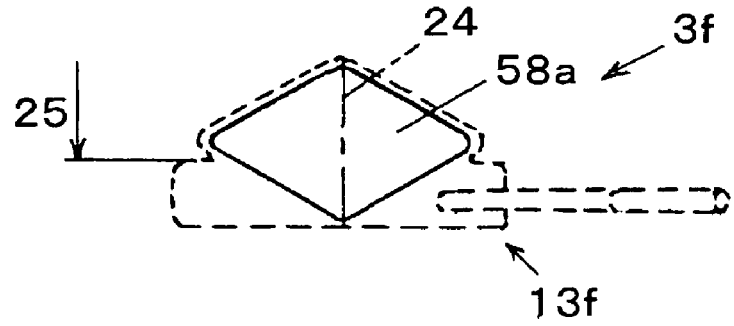
FIG. 31 is a plan view of a putter head of a twenty-eighth embodiment.

FIG. 31 shows a putter head 3*f* which is a modification of the putter head 3*c* shown in FIG. 11. That is, a laterally-elongated rhombic background mark 58*a* which is formed symmetrically while sandwiching an imaginary line axis 24 therebetween has a portion of a profile shape thereof formed in the same shape as a profile shape of a putter head body 13*f* on a back surface side 25 thus forming the putter head 3*f*. Due to such a constitution, it is possible to make a color of the quadrangular background mark 58*a* different from a color of the blurring mark and a color of the putter head body 13*e*. Accordingly, a golfer hardly feels the change of the inclination of the longitudinal line mark whereby the putter head 3*f* can give a sense of smooth and comfortable stroking to the golfer.

Embodiment 29

FIG. 32 shows a putter head 3*g* which is a modification of the putter head 3*b* shown in FIG. 10. That is, a longitudinally-elongated rhombic background mark 57*a* which is formed symmetrically while sandwiching an imaginary line axis 24 therebetween has a portion of a profile shape thereof formed in the same shape as a profile shape of a putter head body 13*g* on a back surface side 25 thus forming the putter head 3*g*. Due to such a constitution, it is possible to make a color of the quadrangular background mark 57*a* different from a color of the blurring mark and a color of the putter head body 13*g*. Accordingly, a golfer hardly feels the change of the inclination of the longitudinal line mark whereby the putter head 3*g* can give a sense of smooth and comfortable stroking to the golfer.

Embodiment 30

FIG. 33 shows a putter head 1*m* which is a modification of the putter head 1*i* shown in FIG. 26. That is, as a fan-shaped background mark which is formed on an upper surface 21 of a putter head body, a background mark 51*b* having an inner mark is formed, wherein a fine strip-like longitudinal line mark 31 is formed on the center of the background mark 51*b* in the longitudinal direction, and a longitudinally elongated modified rhombic ring-shaped mark which is formed of a pair of blurring marks 45*e* having a fixed bold line width and being arranged symmetrically on the background mark 51*b* while sandwiching the fine longitudinal line mark 31 therebetween and non-parallel to the longitudinal line mark 31 thus forming the putter head 1*m*. Further, within an area of the background mark 51*b* having an inner mark, in coloring at least the blurring marks 45*e* which constitute the longitudinal line mark 31 and the blurring marks 45*e* which constitute the ring-like mark, other portions are configured to be colored such that the longitudinal line mark 31 and the ring-like mark 45 become conspicuous. For example, the various combinations including the combination of white and black are adopted. In this case, since the blurring marks 45*e* is formed of the bold line and the longitudinal line mark 31 if formed of the fine line, it is possible to make the blurring marks 45*e* more conspicuous. The same combinations of colors can be adopted by the embodiments shown in FIG. 34, FIG. 35, FIG. 36 and FIG. 38.

Embodiment 31

Figure 34:
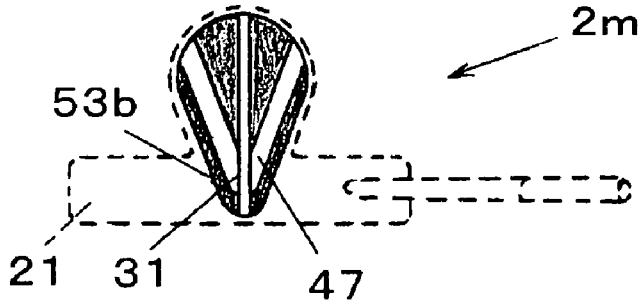
FIG. 34 is a plan view of a putter head of a thirty-first embodiment.

FIG. 34 shows a putter head 2*m* which is a modification of the putter head 2*j* shown in FIG. 28. On a fan-shaped background mark having an inner mark which is formed on an upper surface of a putter head body 21, a fine strip-like longitudinal line mark 31 is formed on the center of the background mark and a V-shaped mark 47 which has a fixed bold line width is arranged symmetrically while sandwiching the longitudinal line mark 31 therebetween thus forming the putter head 2*m*.

Embodiment 32

Figure 35:
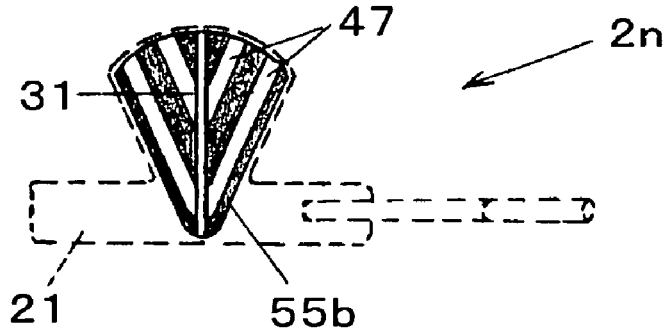
FIG. 35 is a plan view of a putter head of a thirty-second embodiment.

FIG. 35 shows a putter head 2*n* which is a modification of the putter head 2*m* shown in FIG. 34. On a fan-shaped background mark having an inner mark which is formed on an upper surface 21 of a putter head body, a fine strip-like longitudinal line mark 31 is formed on the center of the background mark and a plurality of V-shaped marks 47 which have a fixed bold line width are arranged symmetrically at a given interval while sandwiching the longitudinal line mark 31 therebetween thus forming the putter head 2*n*.

Embodiment 33

Figure 36:
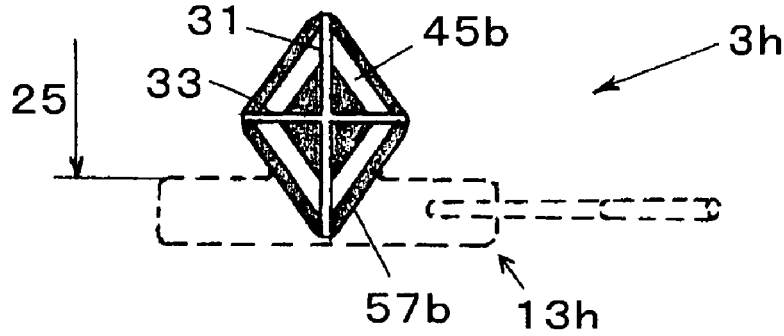
FIG. 36 is a plan view of a putter head of a thirty-third embodiment.

FIG. 36 shows a putter head 3*h* which is a modification of the putter head 3*g* shown in FIG. 32. In the inside of a longitudinally elongated rhombic background mark 57*b* having an inner mark, a rhombic ring-like mark 45*b* having the same shape as a profile shape of the background mark 57*b* and having a fixed line width is formed. On diagonal lines of the background mark which cross each other orthogonally, a strip-like longitudinal line mark 31 and a strip-like lateral line 33 are arranged so as to split the ring-like mark 45*b* in four thus forming the putter head 3*h*. A portion of the profile of the background mark 57*b* on a back surface side 25 has the same constitution as a profile of the putter head body 13*h*.

Embodiment 34

Figure 37:
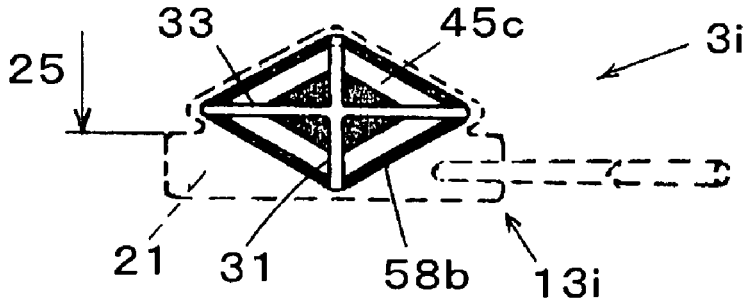
FIG. 37 is a plan view of a putter head of a thirty-fourth embodiment.

FIG. 37 shows a putter head 3*i* which is a modification of the putter head 3*h* shown in FIG. 36. Compared to the longitudinally elongated rhombic background mark shown in FIG. 36, a laterally elongated rhombic background mark 58*b* having an inner mark which is provided with a short longitudinal line mark 31, an elongated lateral line 33 and a rhombic ring mark 45*c* is formed on an upper surface 21 of a putter head body 13*i*, and a portion of a profile shape of the background mark 58*b* is formed in conformity with a profile shape of the putter head body 13*i* on a back surface side.

Embodiment 35

Figure 38:
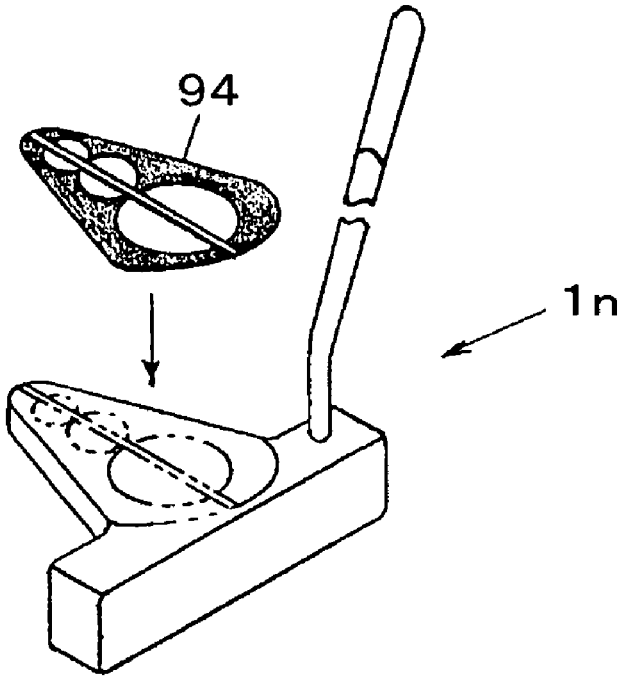
FIG. 38 is a perspective view of a putter head of a thirty-fifth embodiment.

In FIG. 38, a mark which is formed on an upper surface of the putter 1*n* is constituted of a mark sheet 94 which is formed of a thin sheet and is replaceably mounted on the upper surface of the putter 1*n*.

Embodiment 36

Figure 39:
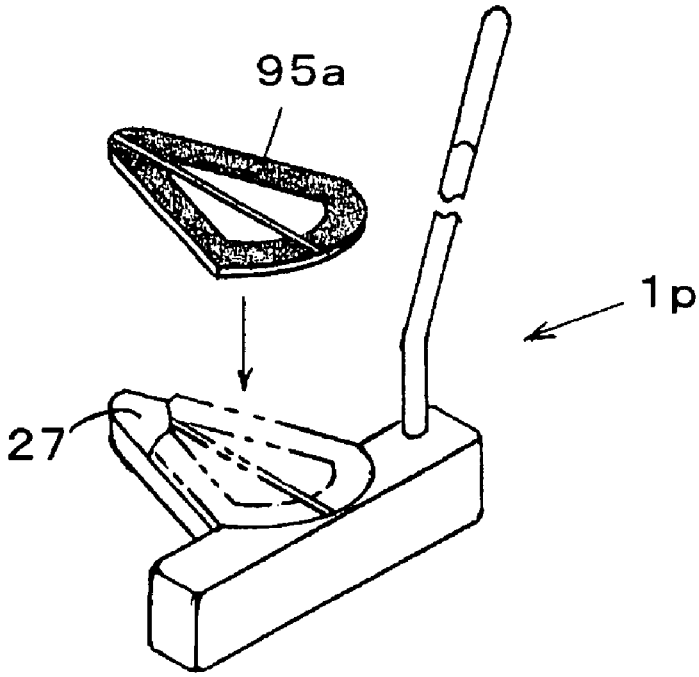
FIG. 39 is a perspective view of a putter head of a thirty-sixth embodiment.

In FIG. 39, a recessed portion is formed in a portion of a head upper surface side of a putter head 1*p* and a blurring mark 95*a* having a shape which allows the blurring mark 95*a* to be accommodated in the recessed portion 27 is replaceably laminated to the recessed portion 27. Accordingly, it is possible to exchange various kinds of blurring marks 95*a* without changing a putter head body which occupies a most portion of a cost of a putter head.

Embodiment 37

Figure 40:
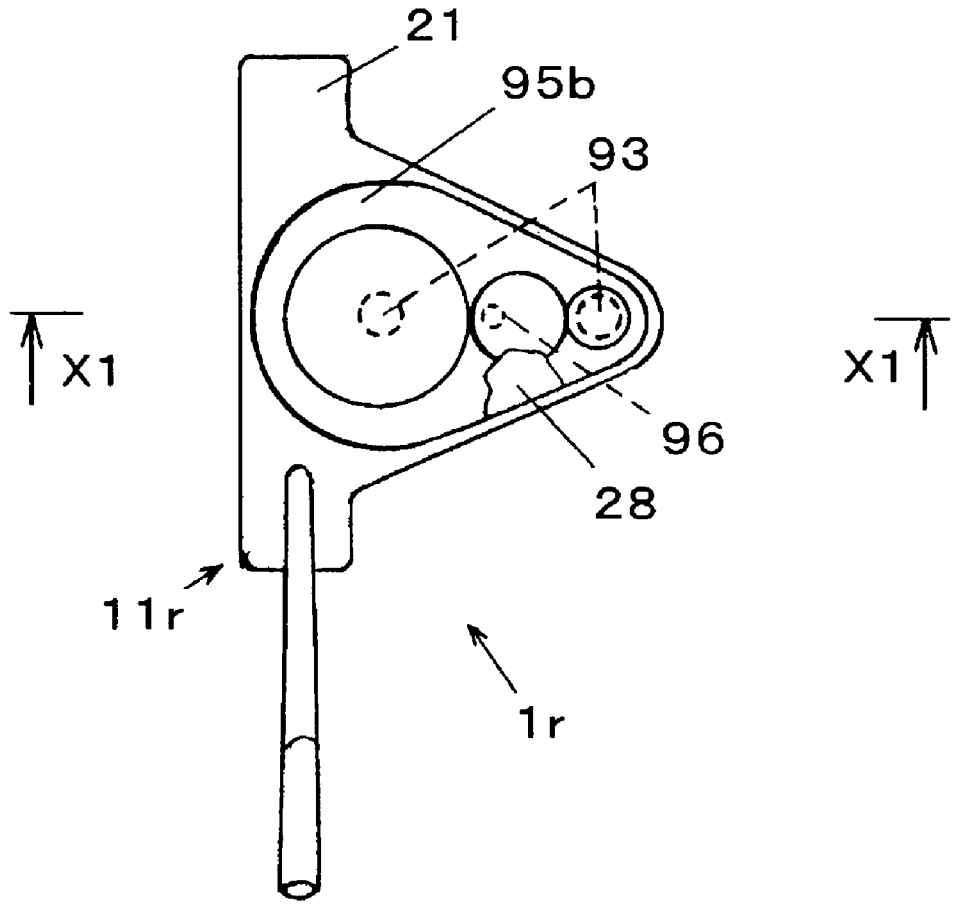
FIG. 40 is a plan view of a putter head of a thirty-seventh embodiment.
Figure 41:
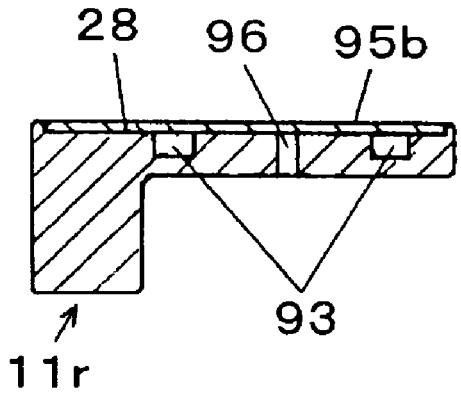
FIG. 41 is a cross-sectional view of the putter head taken along a line XI-XI in FIG. 40.

In FIG. 40 and FIG. 41, with respect to a putter head body 11*r* of a putter 1*r*, a recessed portion 28 is formed in a portion of an upper surface 21 of the putter head body 11*r*, magnets 93 are fixedly secured to the inside of the recessed portion, and a mark plate 95*b* which mounts a mark on an upper surface thereof is accommodated in the recessed portion and is mounted by attraction using the magnet. That is, this embodiment adopts the separate structure. A mark removing hole 96 which allows the removal of the mark 95*b* is formed in an arbitrary position of the recessed portion.

Due to such a mark separable structure, it is possible to easily exchange various kinds of blurring marks 95*a* without changing a putter head body which occupies a most portion of a cost of a putter head. It is preferable to use the sheet-like blurring marks 95*a* to reduce a manufacturing cost.

What is claimed is:

1. A putter head comprising:

a putter head body having a portion thereof connected to a distal end of a putter shaft;

a laterally extending putter face formed on a front portion of the putter head body;

a fine strip-shaped longitudinal line mark capable of being aligned with an imaginary ball hitting line at an address position, the longitudinal line mark being formed on an upper surface of the putter head body and extending rearwardly from a center of the putter face in the direction orthogonal to the putter face; and bold blurring marks formed on the upper surface of the putter head body disposed in a position such that the blurring marks sandwich the longitudinal line mark in a V shape, the blurring marks having profile lines arranged substantially symmetrically and non-parallel with respect to the longitudinal line mark, and the V-shaped bold blurring marks also having a line width larger than a line width of the fine longitiudinal line mark to make the blurring marks conspicuous compared to the fine longitudinal line mark.

2. A putter head according to claim 1, wherein the blurring marks are formed in a line shape and have a line width larger than a line width of the strip-shaped longitudinal line mark.

3. A putter head according to claim 1, wherein the blurring marks have a color different from a color of the strip-shaped longitudinal line mark.

4. A putter head according to claim 1, wherein the profiles of the blurring marks are formed of longitudinally extending lines and lateral widths of the blurring marks are increased from a front end to a rear end of the putter head body.

5. A putter head according to claim 1, wherein the blurring marks are formed of a V-shaped mark which has a given line width and is ananged symmetrically with respect to the longitudinal line mark.

6. A putter head according to claim 1, wherein the blurring marks are formed of a plurality of V-shaped marks which have a given line width and are ananged in a spaced-apart manner in the longitudinal direction and symmetrically with respect to the longitudinal line mark.

7. A putter head according to claim 1, wherein the putter head further includes a background mark which is mounted on a substantially whole upper surface of the putter head body and the longitudinal mark and the blurring marks are formed on an upper surface of the background mark.

8. A putter head according to claim 7, wherein the longitudinal line mark and the blurring marks are colored with a color different from a color of the background mark.

9. A putter head according to claim 7, wherein the background mark is replaceably mounted on the upper surface of the putter head body.

10. A putter head according to claim 9, wherein the background mark is replaceably mounted on the upper surface of the putter head body by making use of a magnetic attraction.

11. A putter head according to claim 1, wherein the longitudinal line mark and the blurring marks are colored with a color different from a color of the putter head body.

12. A putter head according to claim 1, wherein the blurring marks are replaceably mounted on the upper surface of the putter head body.

13. A putter head according to claim 1, wherein the blurring marks are mounted on the upper surface of the putter head body by making use of a magnetic attraction.

14. A putter head according to claim 1, wherein the blurring marks are merged at a rear portion of the putter head body to form a dove-tail shape.

15. A putter head according to claim 1, wherein the blurring marks are formed in a rhombic shape consisting of two V shapes by making a width between the blurring marks being gradually increased toward a center portion of the putter head body from a front portion and a rear portion of the putter head body symmetrically with respect to the strip-like longitudinal line mark.

* * * * *